US007095301B2

(12) United States Patent
Hidaka et al.

(10) Patent No.: US 7,095,301 B2
(45) Date of Patent: Aug. 22, 2006

(54) RESONATOR DEVICE, FILTER, DUPLEXER AND COMMUNICATION DEVICE

(75) Inventors: Seiji Hidaka, Nagaokakyo (JP); Shin Abe, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 106 days.

(21) Appl. No.: 10/857,947

(22) Filed: Jun. 2, 2004

(65) Prior Publication Data

US 2004/0246072 A1 Dec. 9, 2004

(30) Foreign Application Priority Data

Jun. 4, 2003 (JP) ..... 2003-159684
Feb. 17, 2004 (JP) ..... 2004-039792
Apr. 19, 2004 (JP) ..... 2004-123446

(51) Int. Cl.
*H01P 7/00* (2006.01)

(52) U.S. Cl. ..... 333/219; 333/204

(58) Field of Classification Search ..... 333/219, 333/219.1, 202, 203, 204
See application file for complete search history.

(56) References Cited

U.S. PATENT DOCUMENTS 6,937,118 B1 * 8/2005 Hidaka et al. ..... 333/219
2003/0234704 A1 12/2003 Hidaka et al.
2004/0257175 A1 * 12/2004 Hidaka et al. ..... 333/204

FOREIGN PATENT DOCUMENTS

JP 60-1825 1/1985

* cited by examiner

*Primary Examiner*—Robert Pascal
*Assistant Examiner*—Kimberly E Glenn
(74) *Attorney, Agent, or Firm*—Dickstein, Shapiro, Morin & Oshinsky, LLP.

(57) ABSTRACT

A resonator device including a plurality of resonance units formed on a dielectric substrate, each resonance unit having a plurality of conductor lines forming a capacitive area and an inductive area in a ring shape.

20 Claims, 23 Drawing Sheets

SECTION A-A

SECTION B-B

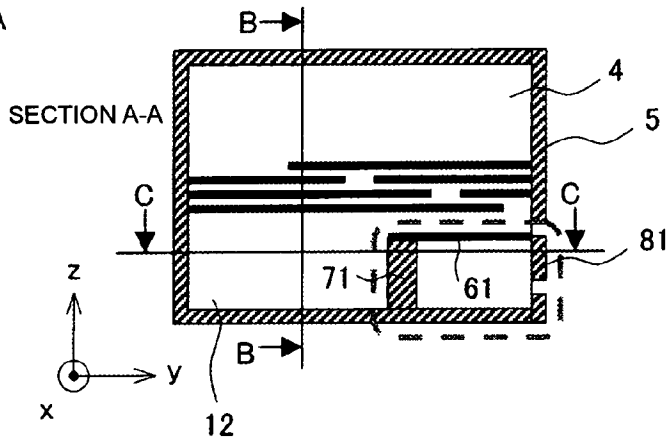
FIG. 16A
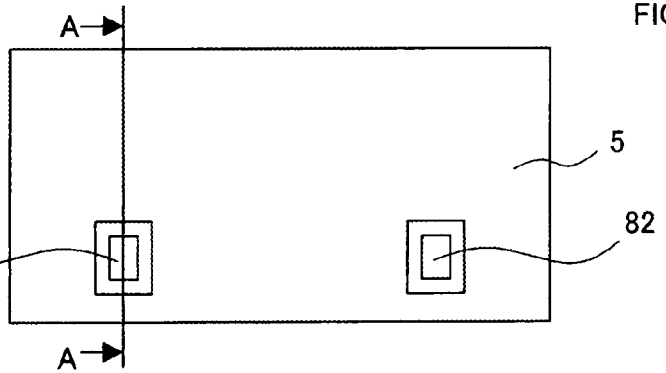
FIG. 16D
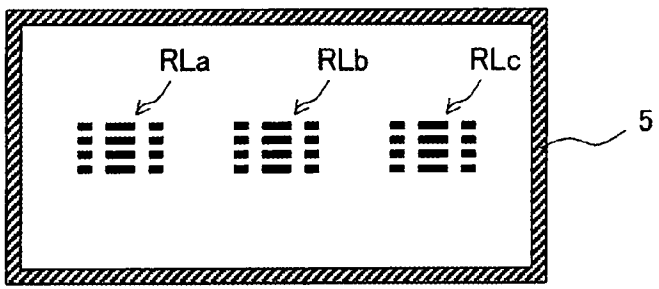
FIG. 16B
SECTION B-B
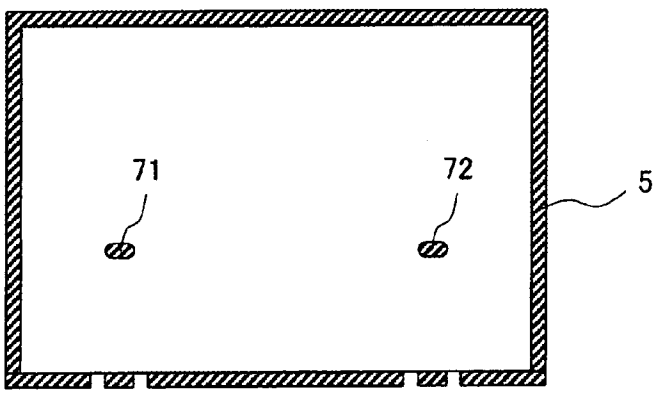
FIG. 16C
SECTION C-C
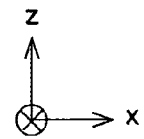

RESONATOR DEVICE, FILTER, DUPLEXER AND COMMUNICATION DEVICE

BACKGROUND OF THE INVENTION

1. Field of the Invention

The present invention relates to a resonator device, filter, duplexer, and communication device which are used in radio communication in microwave band and millimeter wave band and in transmission and reception of electromagnetic waves, for example.

2. Description of the Related Art

Up to now, as a capacitor used in an integrated high-frequency circuit, an interdigital capacitor, in which two strip conductors having a plurality of fingers are disposed so as to face each other on a dielectric substrate, is disclosed in Japanese Unexamined Patent Application Publication No. 60-1825.

In the interdigital capacitor disclosed in Japanese Unexamined Patent Application Publication No. 60-1825, the fingers (comb-shaped electrodes) are alternately arranged to have a interdigital-type structure and the electric-field vectors generated in the space between neighboring two electrodes are alternately reversed. The state is shown in FIG. 23. In FIG. 23, a set of comb-shaped electrodes is constituted by conductor lines 21*a*, 21*b*, and 21*c* on one side and conductor lines 22*a* and 22*b* on the other side which are formed on a dielectric substrate. In the drawing, arrows between the conductor lines represent electric-field vectors and hollow arrows on the conductor lines represent the direction of current.

In this way, in the interdigital-type capacitor, the electric-field vectors between neighboring conductor lines are alternately reversed. According to the law of Ampere-Maxwell, since the displacement current also induces a magnetic field, and the direction of a displacement current proportional to the value of the electric field differentiated with respect to time is locally reversed, the direction of the induction of local magnetic-field vectors sharply changes. When such a magnetic-field vector has a locally sharp curvature, the conductor loss of a real current flowing in conductor lines is produced to cause the deterioration of electrical characteristics. Then, when a resonator is constituted by combining such an interdigital capacitor to an inductor, there is a problem in that a resonator having high no-load Q (Q0) cannot be formed.

Furthermore, when capacitors are constructed by forming fine thin-film conductor lines on a dielectric substrate, although the density can be increased, a practical construction has not been disclosed to form inductors for comprising a resonator and to perform input and output to the outside.

SUMMARY OF THE INVENTION

It is an object of the present invention to provide a resonator device, filter, duplexer, and communication device having a high Q0 resonator to be obtained by reducing the conductor loss in the above capacitor (capacitive area).

1) A resonator device of the present invention comprises a plurality of resonance units, each having a capacitive area and an inductive area formed in a ring shape. In the resonator device, the capacitive area is formed such that the end portions of conductor lines comprising the same resonance unit are made close to each other in the width direction on a dielectric substrate and the capacitive areas are disposed such that the direction of electric-field vectors generated in the capacitive areas is uniform; the inductive area is formed by the portion except for the capacitance area of the conductor lines formed on the dielectric substrate and a conductor formed on a mounting substrate; and the capacitive area and the inductive area are made in a ring shape such that a high-frequency circuit element having the conductor lines formed on the dielectric substrate is mounted on the mounting substrate.

According to the present invention, since each capacitive area is formed such that the end portions of conductor lines comprising the same resonance unit are made close to each other in the width direction on a dielectric substrate and the capacitive areas are disposed such that the direction of electric-field vectors generated in the capacitive areas is uniform, the direction of electric-field vectors between the conductor lines generated in the capacitive areas is uniform and, when compared with the related interdigital capacitor, the conductor loss in the conductor lines is suppressed and a resonator device having high Q0 can be obtained. Furthermore, since capacitive areas are formed on the dielectric substrate, capacitive areas having a highly precise capacitance component can be formed in a limited space, and, since the main part of the inductive areas is formed on the mounting substrate, the inductive areas can be formed by using a conductor prepared by a thick-film printing method. For example, and an inductive area of a relatively low resistance and a fixed inductance component can be formed. Therefore, a smaller resonator device as a whole in which a resonator having a high-precision frequency and high Q0 is provided can be easily produced.

2) A resonator device of the present invention comprises a resonator unit having a capacitive area and an inductive area formed in a ring shape. In the resonator device, the capacitive area is formed such that the end portions of conductor lines comprising the same resonance unit are made close to each other in the thickness direction through at least a dielectric layer on a dielectric substrate; the inductive area is formed by the portion except for the capacitive area of the conductor lines formed on the dielectric substrate and a conductor formed on a mounting substrate; and the capacitive area and the inductive area are made in a ring shape such that a high-frequency circuit element having the conductor lines formed on the dielectric substrate is mounted on the mounting substrate.

According to the present invention, since the conductive area is formed such that the end portions of conductor lines comprising the same resonance unit are made close to each other in the thickness direction through at least a dielectric layer on a dielectric substrate, the direction of electric-field vectors between the conductor lines generated in the capacitance area become uniform, and, as a result, the conductor loss of the conductor lines is suppressed and a resonator device having high Q0 can be obtained. Furthermore, since the capacitive area is formed on the dielectric substrate, in the same way as described above, a smaller resonator as a whole in which a resonator having a high-precision frequency and high Q0 is provided can be easily produced.

3) In the resonator device of the present invention in 1) or 2), the conductor lines formed on the dielectric substrate are a plurality of conductor lines parallel to each other and the width of the whole or a part of each conductor line is less than the skin depth at the frequency of a signal being propagated on the conductor lines.

According to the present invention, since the conductor lines formed on the dielectric substrate are a plurality of conductor lines parallel to each other and the width of the whole or a part of each conductor line is less than the skin depth at the frequency of a signal being propagated on the conductor lines, the edge effect is decreased and the conductor loss is further suppressed to increase Q0 of a resonator.

4) A resonator device of the present invention comprises a plurality of resonance units, each having a capacitive area and an inductive area formed in a ring shape. In the resonator device, the capacitive area is formed such that the end portions of conductor lines comprising the same resonance unit are made close to each other in the thickness direction through a dielectric layer and the capacitive areas are disposed in a multilayer substrate such that neighboring capacitive areas do not overlap in the thickness direction; and the inductive area is formed by the portion except for the capacitive area of the conductor lines formed in the multilayer substrate and a conductor formed on at least a part of the outside surface of the multilayer substrate.

According to the present invention, since the capacitive area is formed such that the end portions of conductor lines comprising the same resonance unit are made close to each other in the thickness direction through a dielectric layer and the capacitive areas are disposed in a multilayer substrate such that neighboring capacitive areas do not overlap in the thickness direction, the direction of electric-field vectors generated between the neighboring conductor lines in the thickness direction generated in the capacitance area becomes uniform, and the conductor loss of the conductor lines is suppressed and, as a result, a resonator device having high Q0 can be obtained. Furthermore, since the inductive area is formed by the portion except for the capacitive area of the conductor lines formed in the multilayer substrate and a conductor formed on at least a part of the outside surface of the multilayer substrate, the operation of resonance becomes possible only by the multilayer substrate and, as a result, a smaller device can be easily produced.

5) In the resonator device of the present invention in 4), the thickness of the whole or a part of the conductor lines formed in the multilayer substrate is made less than the skin depth at the frequency of a signal being propagated on the conductor lines.

According to the present invention, since the thickness of the whole or a part of the conductor lines formed in the multilayer substrate is made less than the skin depth at the frequency of a signal being propagated on the conductor lines, the skin effect and the edge effect are decreased and the conductor loss is further suppressed. As a result, a resonator device having high Q0 can be obtained.

6) In the resonator device of the present invention in 4) or 5), the capacitance of the capacitive area of the outermost resonance unit in the thickness direction is made larger than the capacitance of the capacitive areas of the other resonance units.

According to the present invention, since the capacitance of the capacitive area of the outermost resonance unit in the thickness direction is made larger than the capacitance of the capacitive areas of the other resonance units, when a section of the portion where the plurality of resonance units are laminated is viewed, the magnetic field generated by the current flowing through inductive areas on the other layers decreases and the magnetic field tends to be distributed so as to encircle the whole laminated conductor lines. As a result, no-load Q of the resonator is improved.

7) In the resonator device of the present invention in 4) or 5), the plurality of resonance units are formed such that the more outside in the thickness direction the resonance unit is disposed, the larger the capacitance of the capacitive area is made.

According to the present invention, since the plurality of resonance units are formed such that the more outside in the thickness direction the resonance unit is disposed, the larger the capacitance of the capacitive area is made, when a section of the portion where the plurality of resonance units are laminated is viewed, the magnetic field generated by the current flowing through inductive areas on the other layers decreases and the magnetic field tends to be distributed so as to encircle the whole laminated conductor lines. As a result, no-load Q of the resonator is improved.

8) In the resonator device of the present invention in 1) to 3), a high-frequency circuit element formed on the dielectric substrate is mounted on the multilayer substrate of the resonator device.

According to the present invention, since a high-frequency circuit element formed on the above dielectric substrate is mounted in the multilayer substrate of the above resonator device, the resonator made of the multilayer substrate and the high-frequency circuit element and the resonator formed on the multilayer substrate are operated together and, as a result, the integration of the resonator device can be increased.

9) In the resonator device of the present invention in 1) to 8), the whole or a part of the conductor or the conductor lines is made of a superconductor material.

According to the present invention, since the whole or a part of each conductor is made of a superconductor material, the conductor loss of the conductor lines is suppressed and a resonator device having high Q can be formed. Furthermore, since the maximum current density is suppressed on the conductor lines, also when a signal of a relatively high power is handled, the resonator device can be made smaller in the range where the critical current density of the superconductor is not exceeded.

10) In the resonator device of the present invention in 1) to 9), the conductor lines formed on the dielectric substrate are a plurality of conductor lines parallel to each other and the width of the whole or a part of each conductor line is gradually made smaller from the middle to the outside in the direction perpendicular to the extending direction of the conductor lines.

According to the present invention, since the conductor lines formed on the dielectric substrate are a plurality of conductor lines parallel to each other and the width of the whole or a part of each conductor line is gradually made smaller from the middle to the outside in the direction perpendicular to the extending direction of the conductor lines, the loss due to the edge effect is reduced and Q0 of the resonator can be effectively increased.

11) A filter of the present invention comprises a resonator device stated in any one of 1) to 10) and input-output means for a signal coupled to a resonance unit of the resonator device.

According to the present invention, since a filter comprises one of the above resonator devices and input-output means for a signal coupled to a resonance unit of the resonator device, a smaller filter having a smaller insertion loss can be obtained.

12) A duplexer of the present invention comprises a transmission filter; and a reception filter. In the duplexer, the above filter in 11) is used in the transmission filter, in the reception filter, or in both of the transmission filter and the reception filter.

According to the present invention, a smaller duplexer having a smaller insertion loss can be obtained.

13) A communication device of the present invention comprises at least either of the filter in 11) and the duplexer in 12).

According to the present invention, the insertion loss of an RF transmission-reception portion is reduced and a communication device having high communication quality such as good noise characteristics, good transmission speed, etc., can be obtained.

BRIEF DESCRIPTION OF THE DRAWINGS

FIGS. 16A to 16D show a filter according to an eleventh embodiment of the present invention;

DESCRIPTION OF THE PREFERRED EMBODIMENTS

Hereinafter, a resonator device, filter, duplexer, and communication device according to the present invention are described with reference to the accompanying drawings.

Figure 1C:
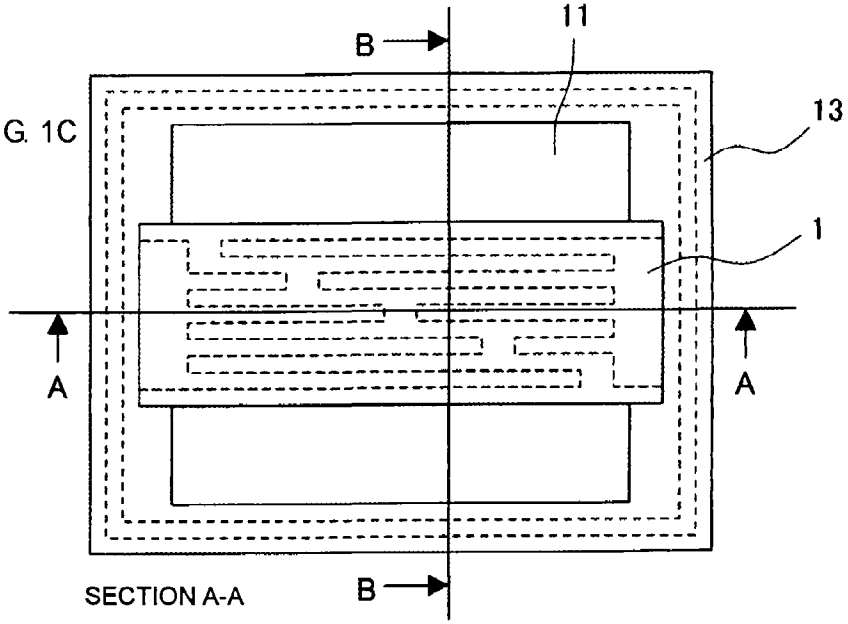
FIGS. 1A to 1C show a resonator device according to a first embodiment of the present invention.
Figure 1A:
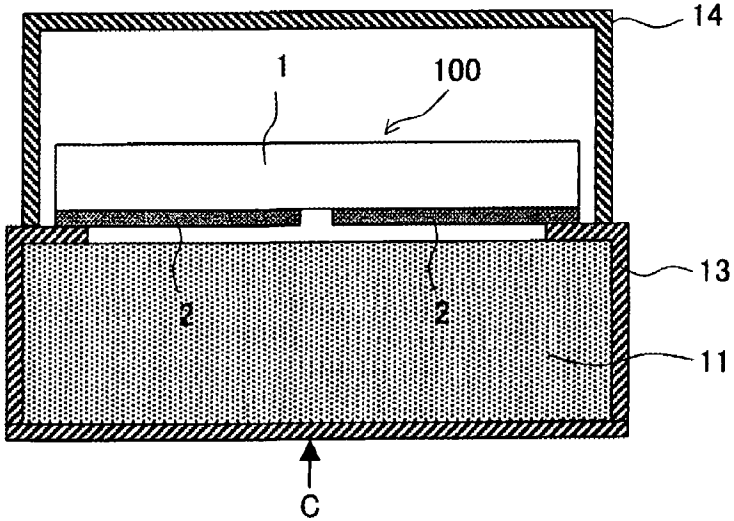
Figure 1B:
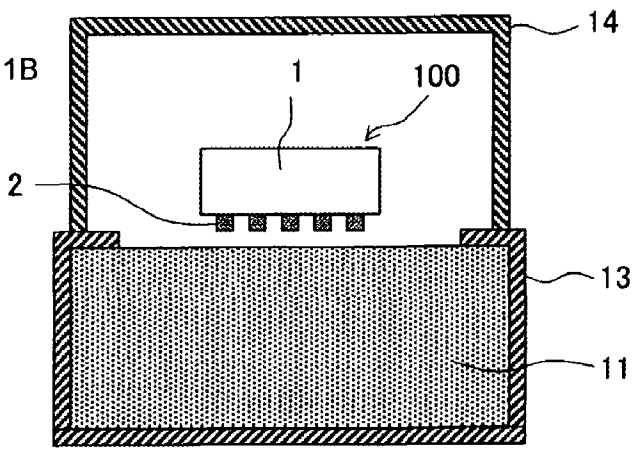

FIGS. 1A to 1C show a resonator device according to a first embodiment of the present invention. FIG. 1C is a top view of the resonator device with an upper shielding cap 14 removed, FIG. 1A is a sectional view taken on line A—A of FIG. 1C, and FIG. 1B is a sectional view taken on line B—B of FIG. 1C. This resonator device contains a dielectric substrate 1 having conductor lines 2 formed thereon, a mounting substrate 11 having a shielding electrode 13 formed thereon, and a shielding cap 14.

A high-frequency circuit element 100 is constructed by forming the conductor lines 2 on the dielectric substrate 1. No grounding electrode is formed on the surface of the dielectric substrate 1 opposite to the surface where the conductor lines 2 are formed. The high-frequency circuit element 100 functions as capacitive areas and a part of inductive areas. Furthermore, the shielding electrode 13 formed on the mounting substrate 11 and the shielding cap 14 function as a part of the inductive areas. The shielding electrode 13 formed on the mounting substrate 11 is a conductor.

In the high-frequency circuit element 100, a conductor film of Cu, Ag, Au, etc. is formed on the dielectric substrate 1 made of dielectric ceramics and the conductor film is patterned by photolithography. Furthermore, the mounting substrate 11 is made of a multilayer substrate having a plurality of ceramic green sheets on which a thick conductor film of a fixed thickness is printed, the multilayer substrate being fired.

As shown in FIG. 1A, when the high-frequency circuit element 100 is mounted on the mounting substrate 11, a part of the conductor lines 2 are made conductive to the shielding electrode 13. In this state, a capacitive area and an inductive area, which are ring-shaped together with the shielding electrode 13, constitute a resonance unit.

Figure 2:
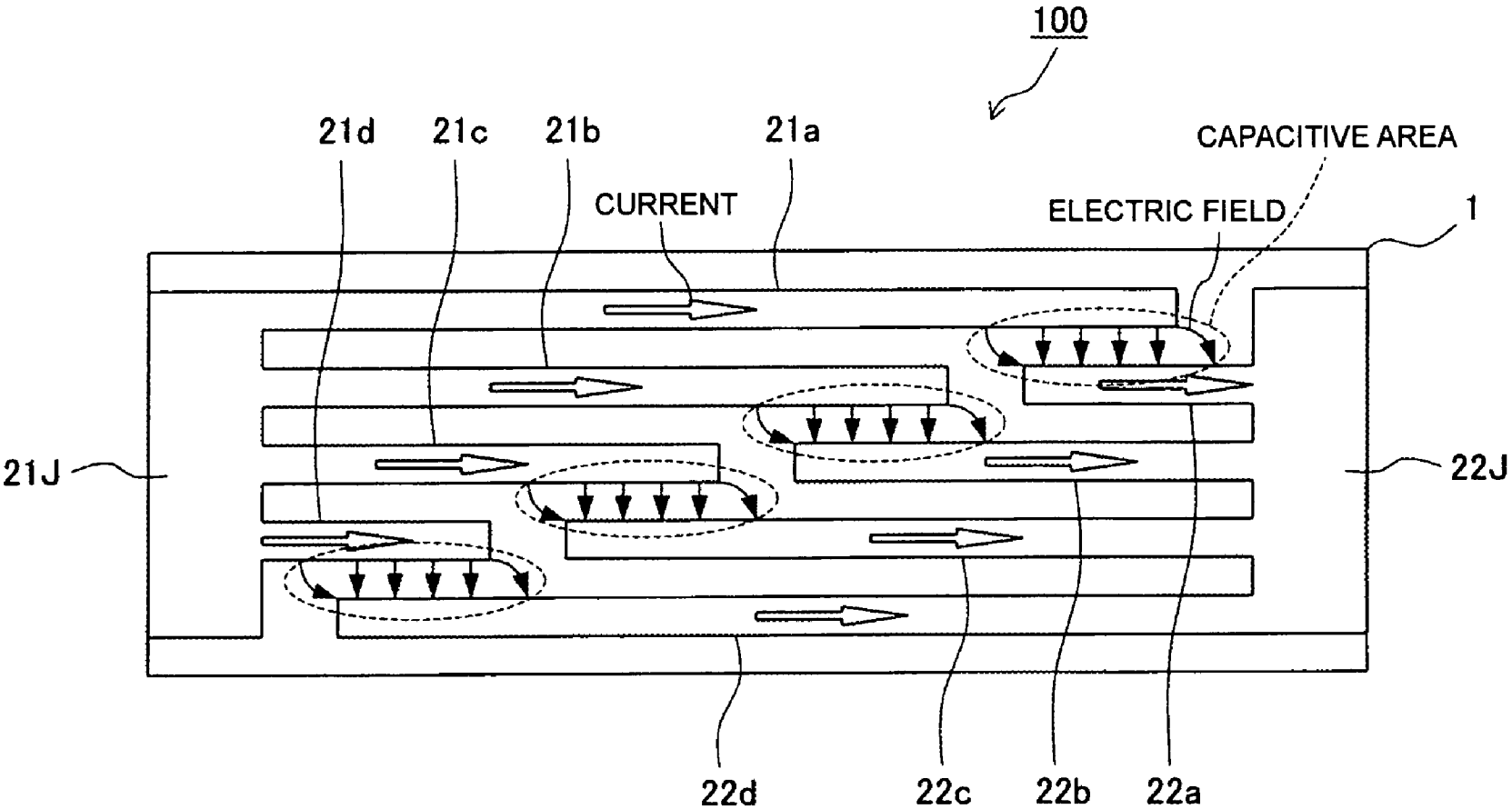
FIG. 2 is a top view of a high-frequency circuit element of the resonator device.

FIG. 2 shows the shape of the conductor lines formed on the dielectric substrate 1 of the high-frequency circuit element 100, the electric-field vectors generated between the conductor lines, and the direction of the current flowing in the conductor lines. The dielectric substrate 1 is in the form of a rectangular solid, and the conductor lines 21*a* to 21*d* and 22*a* to 22*d* having a fixed line width and a fixed line length thereof are formed on one surface of the dielectric substrate 1.

Out of these conductor lines, each set of conductor lines 21*a* and 22*a*, 21*b* and 22*b*, 21*c* and 22*c*, and 21*d* and 22*d* belongs to the same resonance unit. That is, four resonance units are shown in this example. One end of each of the conductor lines 21*a* and 22*a* is close to each other in the width direction over a fixed distance. Furthermore, one end of each of the conductor lines 21*b* and 22*b* is also made close to each other in the width direction over a fixed distance. The same thing can be said about the sets of the conductor lines 21*c* and 22*c* and conductor lines 21*d* and 22*d*.

Figure 23:
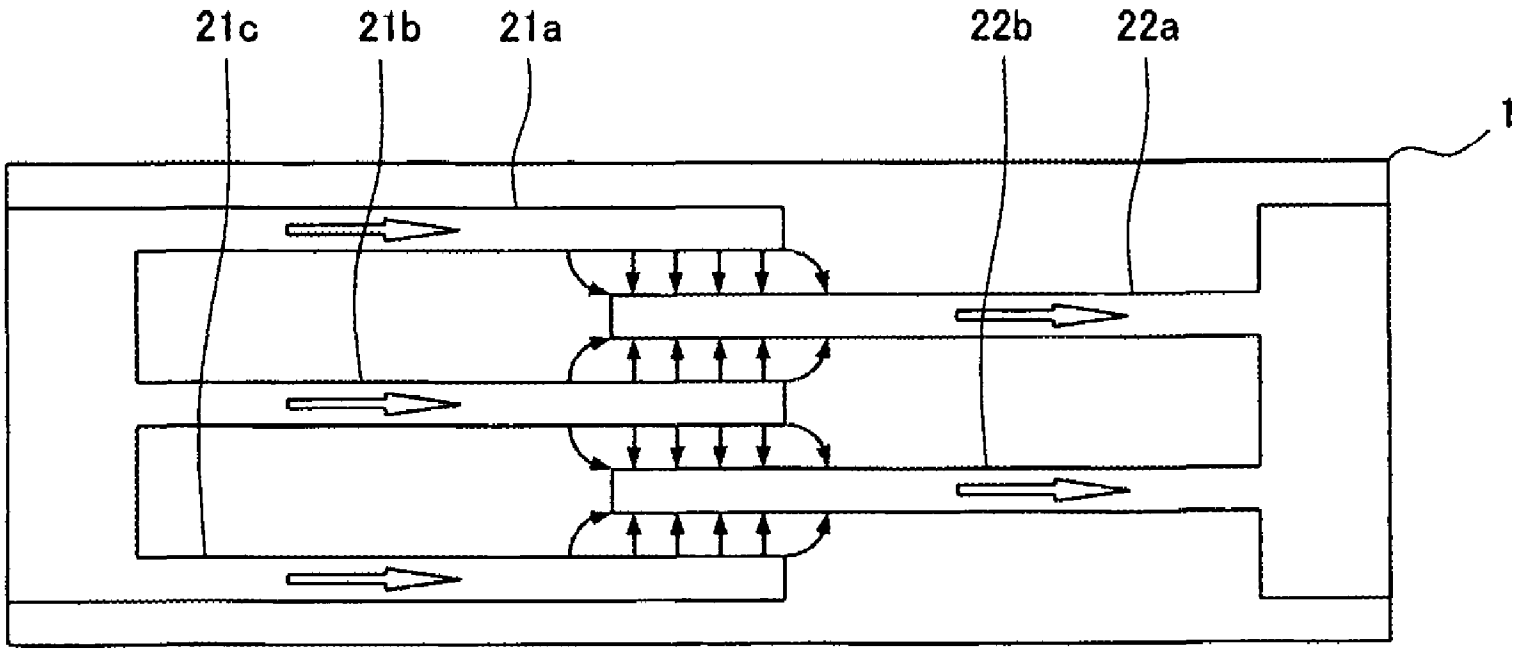
FIG. 23 PRIOR ART
FIG. 23 shows a related interdigital capacitor.

In this way, as shown by the encircling lines in FIG. 2, the portions where the conductor lines are close to each other in the width direction constitute a capacitive area. Since the position of each capacitive area is moved little by little so that the neighboring capacitive areas may not come close to each other in the width direction of the conductor lines (in the direction perpendicular to the extending direction of the conductor lines), which is different from the case where the position of each capacitive area is arranged in the direction perpendicular to the extending direction of the conductor lines as shown in FIG. 23, the electric-field vectors generated in the capacitive areas become uniform in direction. In FIG. 2, the arrows between the neighboring conductor lines represent electric-field vectors and the hollow arrows along the conductor lines represent the direction of current, respectively. In the state shown in FIG. 2, the direction of the electric-field vectors generated in each capacitive area face in one direction from the upper part to the lower part in the drawing.

The conductor lines 21*a* to 21*d* are commonly connected at each end to a connection portion 21J. In the same way, the conductor lines 22*a* to 22*d* are commonly connected at each end to a connection portion 22J.

Figure 3A:
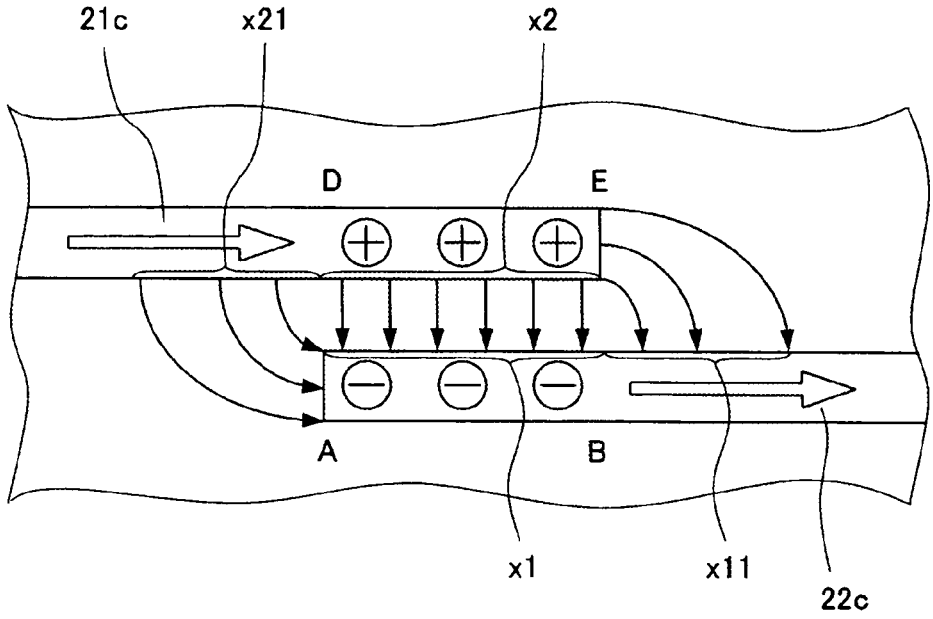
FIGS. 3A and 3B show the distribution of electric field in the vicinity of both ends of conductor lines and the distribution of current density on the conductor lines of the resonator device.
Figure 3B:
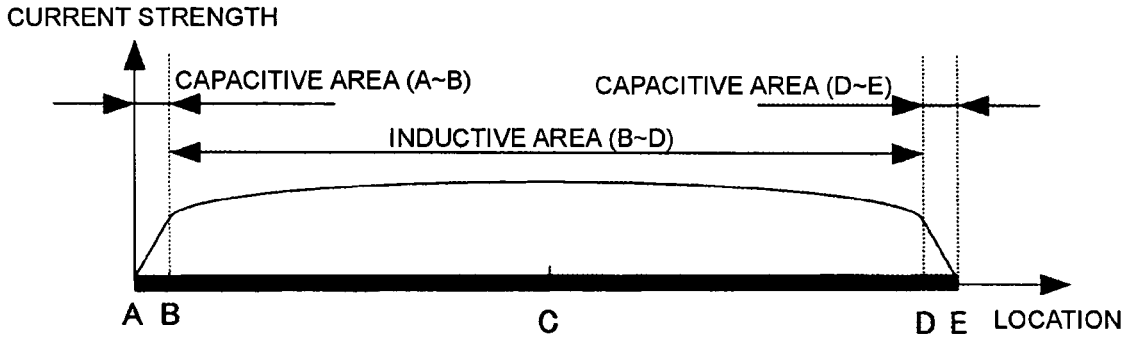

FIGS. 3A and 3B show the distribution of the electric field in each of the capacitive areas and the distribution of the electric current density on each conductor line. In the example shown in FIG. 3A, the electric field is concentrated in the portion where the conductor lines 21*c* and 22*c* are made close to each other in the width direction, that is, in the end portions x1 and x2. Furthermore, the electric field is also distributed between one end portion of the conductor line 21*c* and the vicinity x11 of the end portion of the conductor line 22*c* and between one end portion of the conductor line 22*c* and the vicinity x21 of the end portion of the conductor line 21*c*.

Regarding the distribution of the current density, as shown in FIG. 3B, the current strength rapidly increases from point A to point B of the conductor line, the current strength is substantially constant in the area between B and D, and the current strength rapidly decreases from D to E. The current strength becomes zero at both ends. Point C represents the middle of the inductive area in FIG. 3B. The middle of the shielding electrode 13 shown in FIG. 1A is represented by point C.

The area A to B and D to E where the end portions of the conductive lines come close to each other is a capacitive area and the other area B to D can be called an inductive area. The capacitive area and the inductive area produce resonance. That is, when this resonator is viewed as a lumped circuit, the resonator constitutes an LC resonance circuit.

Hereinafter, a ring-shaped unit having such a capacitive area and an inductive area is called a resonance unit.

In this way, when a capacitive area is provided in the dielectric substrate 1 and an inductive area is provided in a part of the dielectric substrate 1 and the mounting substrate 11, these capacitive area and inductive area form a ring-shaped resonance unit. According to this first embodiment, since four capacitive areas are provided, a resonator having four resonance units is provided. However, the end portions of a plurality of conductor lines 21*a* to 21*d* and 22*a* to 22*d* are commonly connected to the connection portions 21J and 22J and the shielding electrode 13 on the side of the mounting substrate 11 is continuously formed from the side face to the bottom face of the mounting substrate 11, and accordingly, the inductive areas of the resonance units are not separated from each other. Therefore, the shielding electrode 13 on the side of the mounting substrate 11 serves as the inductive areas of the four resonance units.

In the inductive areas excluding the above capacitive areas, although the conductor lines are close to each other, almost no capacitance is generated between the conductor lines. That is, in the example shown in FIG. 3A, the positive charge and negative charge are concentrated in the end portions (capacitive area) of the conductor lines 21*c* and 22*c* and the charge becomes zero in the inductive area. When the charge is zero, since no displacement current flows between the neighboring conductor lines 21*c* and 22*c*, no capacitance is generated. Accordingly, even if a plurality of resonance units are combined in this way, the capacitive areas and the inductive areas operate.

In FIG. 2, in accordance with the arrangement of the four capacitive areas, the ratio of the current flowing in each conductor line is determined. Qualitatively, a large current flows into a set of conductor lines having a large capacitance. Accordingly, in order to further reduce the total conductor loss, the capacitance of each capacitive area, that is, the length of the portions of the conductor lines facing each other in the width direction is determined.

Thus, since the direction of the electric-field vectors generated in the capacitive areas are uniform, the direction of the magnetic-field vectors induced by the displacement current locally have no sharp curvature. Accordingly, the conductor loss of the capacitive areas is reduced.

The effect of the above resonator device is as follows.

1) Each conductor line on the dielectric substrate and the shielding electrode 13 on the mounting substrate function as a half-wave transmission line which is open-circuited at both ends.

2) Positive and negative electric charges are generated at the tip portion of each conductor line and the portions at both ends of the conductor line overlapping with each other function as a capacitive element.

3) Since capacitance is produced on the same surface of the dielectric substrate, even if there is no grounding electrode on the opposite surface, resonance takes place.

4) The current strength of a current flowing through each conductor line is determined in accordance with the capacitance of each capacitive area.

5) The current of each conductor line rotates in a plane perpendicular to the surface of the dielectric substrate 1 and parallel to the extending direction of each conductor line.

6) Since the direction of the electric-field vectors generated in the conductive areas are uniform, the conductor loss in the conductor lines is suppressed when compared with the related interdigital capacitor and a resonator device having high Q0 can be obtained.

7) Since the capacitive areas are formed on the dielectric substrate, capacitive areas having a high-precision capacitance component by thin-film fine processing can be formed in a limited space, and, since the main part of the inductive areas are formed on the mounting substrate, inductive areas having a fixed inductance component of a relatively low resistance can be formed by using a conductor prepared by a thin-film printing method. Therefore, a smaller resonator device as a whole having a resonator of a high-precision resonance frequency and high Q0 can be produced.

8) Since substantially in-phase currents flow in neighboring conductor lines, a current is distributed by multiplexing a conductor line and the current concentration by the edge effect is decreased by the distribution of the current density. Because of the decrease of the concentration of the current by the edge effect, the conductor loss is suppressed. Furthermore, the maximum magnetic-field strength is suppressed by the decrease of the concentration of the current.

9) Since the capacitive areas of the resonance unit are close to each other, the capacitance of the resonator concentrates in a local area on a plurality of conductor lines. Therefore, the functions of the capacitive and inductive portions are made clearer. Accordingly, it becomes easy to design the coupling to another circuit using the resonator.

Figure 4:
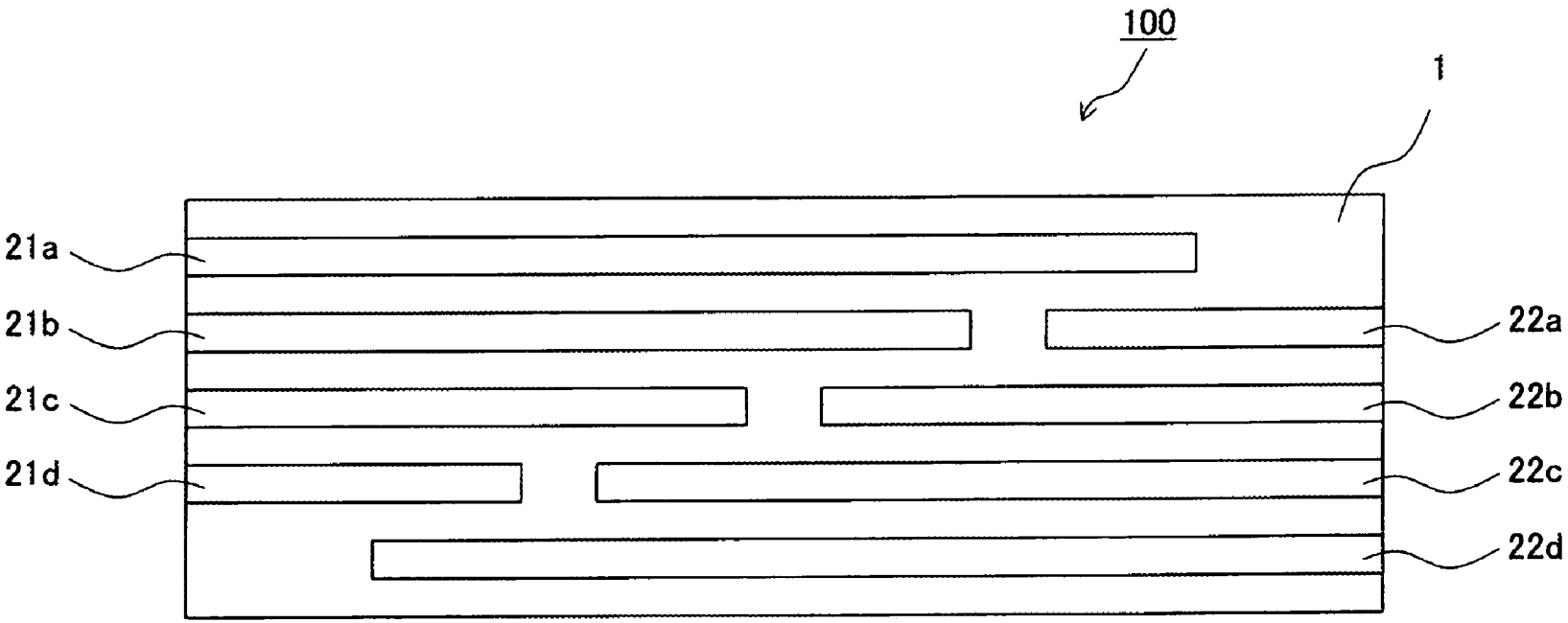
FIG. 4 is a top view of a high-frequency circuit element used in a resonator device according to a second embodiment of the present invention.

FIG. 4 shows a high-frequency circuit element 100 used in a resonator device according to a second embodiment of the present invention. In the first embodiment, although the end portion of each of the plurality of conductor lines is commonly connected to the connection portions 21J and 22J as shown in FIG. 2, in the example shown in FIG. 4, the conductor lines 21*a* to 21*d* and 22*a* to 22*d* are kept separate. Even if constructed in this way, when the conductor lines 21*a* to 21*d* and 22*a* to 22*d* are mounted on the mounting substrate 11 where the shielding electrode 13 shown in FIGS. 1A to 1C is formed, the inductive areas on the side of the dielectric substrate 1, the inductive areas on the side of the mounting substrate, and the capacitive areas on the side of the dielectric substrate 1 perform resonance.

Figure 5B:
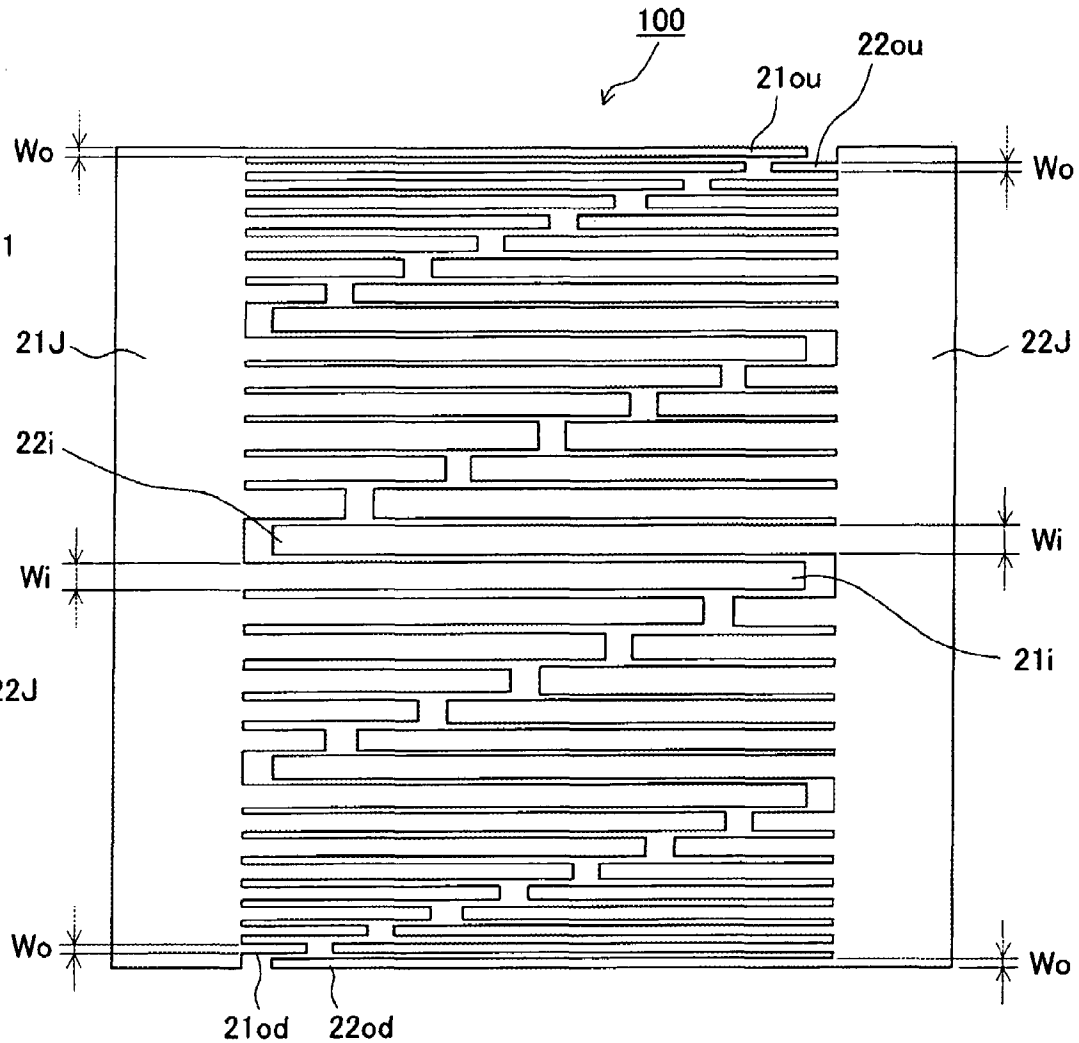
FIGS. 5A and 5B are top views of high-frequency circuit elements used in a resonator device according to a third embodiment of the present invention.
Figure 5A:
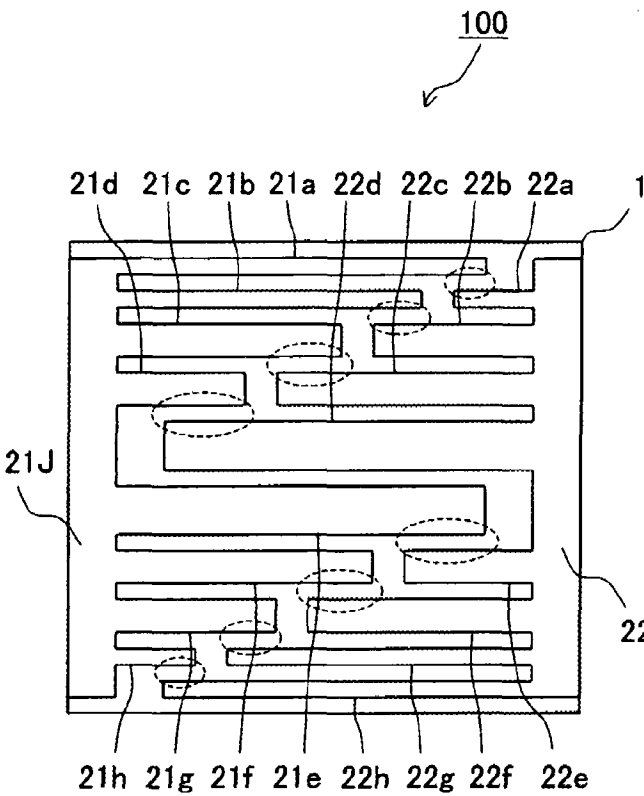

FIGS. 5A and 5B show a dielectric substrate used in a resonator device according to a third embodiment of the present invention. In the examples shown in FIGS. 2 and 4, four capacitive areas are contained, but, in examples shown in FIGS. 5A and 5B, the number of capacitive areas is increased and the line width of each conductor line is made different. In the example shown in FIG. 5A, eight sets of conductor lines 21*a* to 21*h* and 22*a* to 22*h* and eight captive areas enclosed by broken lines in the drawing are formed. One end of these conductor lines 21*a* to 21*h* is commonly connected to the connection portion 21J and one end of these conductor lines 22*a* to 22*h* is commonly connected to the connection portion 22J.

FIG. 5B shows an example in which the number of neighboring end portions in the width direction of conductor lines, that is, the number of capacitive areas, are increased.

Furthermore, in the examples shown in FIGS. 5A and 5B, the width of the conductor lines are gradually reduced from the middle to the outside in the direction perpendicular to the extending direction of the plurality of conductor lines. In the example shown in FIG. 5B, the width Wi of the middle conductor lines 21*i* and 22*i* is the largest and the width Wo of the most outside conductor lines 21*ou*, 22*ou*, 21*od*, and 22*od* is the least. The width of the other conductor lines is gradually decreased from the middle to the outside.

In this way, the loss due to the edge effect is reduced and Q0 of the resonator is effectively increased such that a plurality of the conductor lines parallel to the dielectric substrate 1 is formed and that the width of conductor lines is gradually reduced from the middle to the outside in the direction perpendicular to the extending direction of the conductor lines. That is, since the outer conductor lines out of the plurality of conductor lines show a larger edge effect, Q0 of the resonator can be effectively increased such that the total line width is kept larger as much as possible by reducing the width of conductor lines in the outside rather than in the middle and, as a result, the current flowing in each conductor line is effectively distributed.

Figure 6:
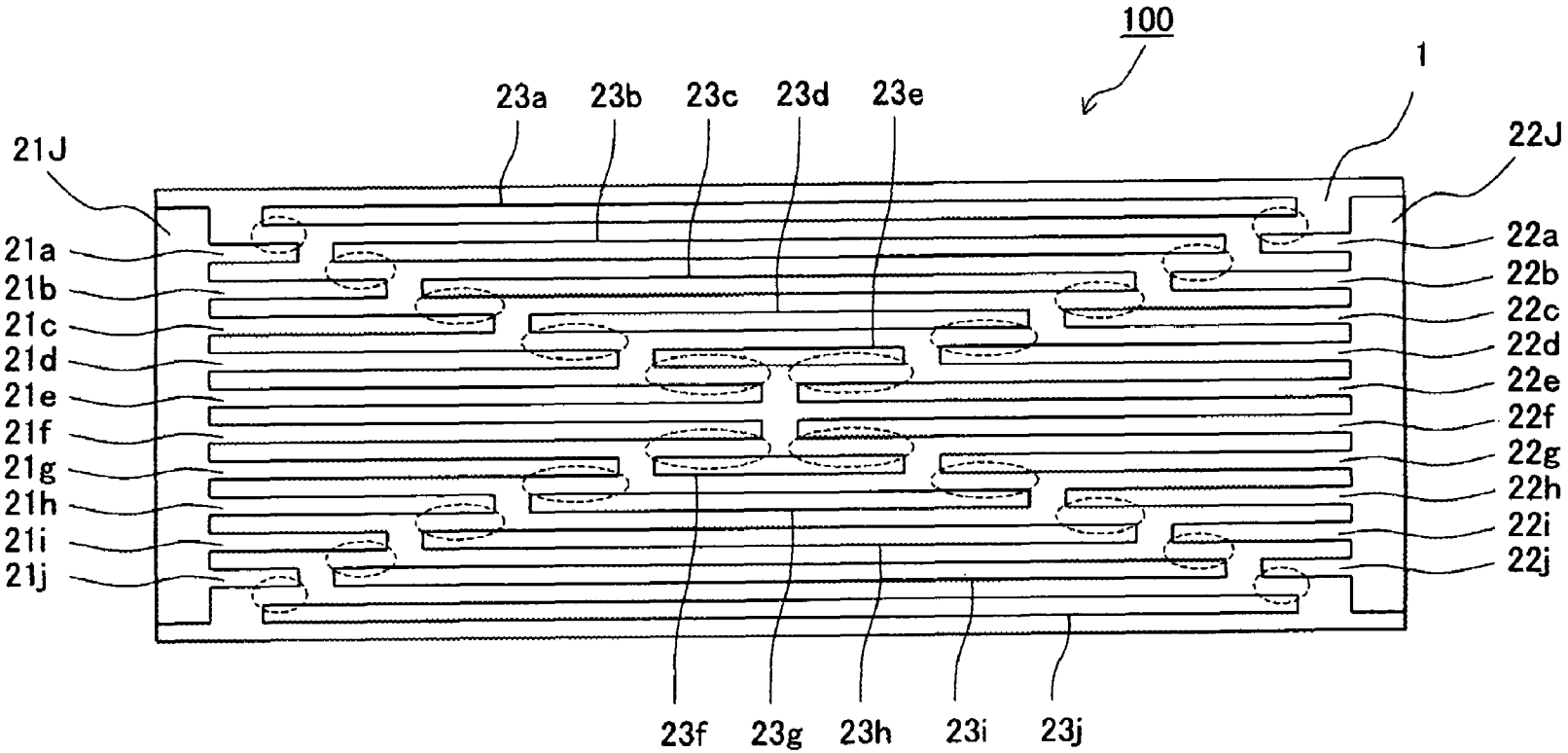
FIG. 6 is a top view of a high-frequency circuit element used in a resonator device according to a fourth embodiment of the present invention.

FIG. 6 shows a high-frequency circuit element 100 used in a resonator device according to a fourth embodiment of the present invention. Different from the high-frequency circuit elements shown as the first to third embodiments, a plurality of capacitive areas and a plurality of inductive areas are provided in one resonance unit. That is, in the example in FIG. 6, a plurality of conductor lines shown by 21*a* to 21*j*, 22*a* to 22*j*, and 23*a* to 23*j* are formed on one surface of the dielectric substrate 1 and the end portions, close to each other in the width direction, of the conductor lines form capacitive areas (areas enclosed by broken lines in the drawing). For example, the vicinity of one end of the conductor line 21*a* is close to the vicinity of one end of the conductor line 23*a* in the width direction over a fixed distance, and the vicinity of the other end of the conductor line 23*a* is close to the vicinity of one end of the conductor line 22*a* in the width direction over a fixed distance. These capacitive areas, the inductive areas excluding the capacitive areas of the conductor lines 21*a*, 22*a*, and 23*a*, and the inductive areas due to the shielding electrode of the mounting substrate for mounting the high-frequency circuit element 100 form one resonance unit. Accordingly, in this example, one resonance unit contains two capacitive areas and two inductive areas.

The same thing can be said about the other resonance unit neighboring the above-described resonance unit, and, for example, the conductor lines 21*b*, 22*b*, and 23*b* and the conductor on the side of the mounting substrate constitute another resonance unit. This example contains ten resonance units.

Moreover, in the same way, one resonance unit may contain three or more of capacitive areas and inductive areas, respectively. Furthermore, in the example shown in FIG. 6, the conductor lines 21*a* to 21*j* and 22*a* to 22*j* connected to the connection portions 21J and 22J are arranged such that the closer to the middle in the arrangement, the longer the capacitive area; and the closer to the ends, the shorter the capacitive area. However, the location of each capacitive area may be arranged such that the closer to the ends, the longer the capacitive area; and the closer to the middle, the shorter the capacitive area.

Figure 7A:
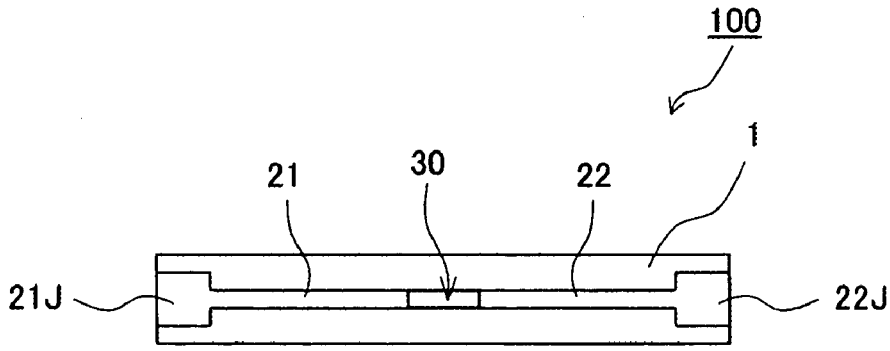
FIGS. 7A to 7C show a high-frequency circuit element in a resonator device according to a fifth embodiment of the present invention.
Figure 7B:
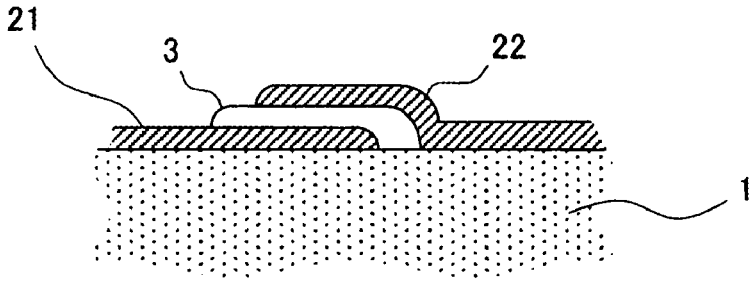

Next, a resonator device according to a fifth embodiment of the present invention is described with reference to FIGS. 7A to 7C and 8. FIG. 7A is a top view of a high-frequency circuit element 100 and FIG. 7B is a sectional view of its main part. In the first to fourth embodiments, the end portions of conductor lines forming the same resonance unit are made close to each other in the width direction on the dielectric substrate, but, in this example, the end portions of conductor lines are made close to each other in the thickness direction through a dielectric layer on the dielectric substrate 1.

In the example shown in FIG. 7A, the conductor lines 21 and 22 are formed on the surface of the dielectric substrate 1 and a dielectric layer 3 is disposed between one end portions of the conductor lines 21 and 22. A capacitive area 30 is formed in the portion where the end portions of the conductor lines 21 and 22 are made close to each other in the thickness direction through the dielectric layer. The other ends of the conductor lines 21 and 22 form the connection portions 21J and 22J to the mounting substrate.

When the high-frequency circuit element 100 in FIGS. 7A and 7B is mounted on the same mounting substrate as shown in FIGS. 1A and 1B, the other portions of the conductor lines 21 and 22 and the conductor on the above mounting substrate function as an inductive area. Then, the inductive areas and capacitive area 30 form one resonance unit which functions as an LC resonance circuit when viewed as a lumped-constant circuit to comprise a resonator device.

Figure 8:
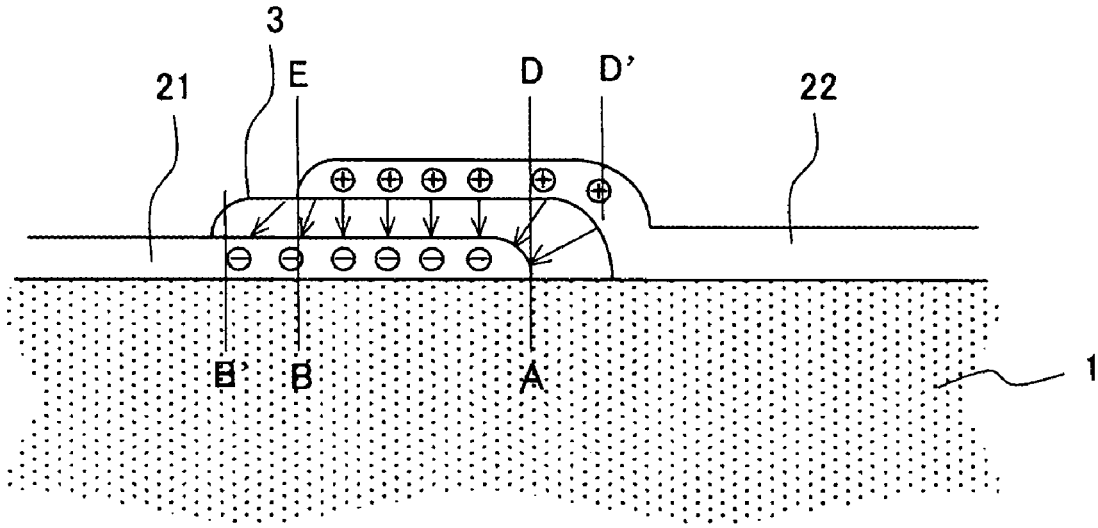
FIG. 8 shows the distribution of electric field in the vicinity of both ends of conductor lines of the high-frequency circuit element.

FIG. 8 shows the above-described capacitive area. FIG. 8 also shows the four locations A, B, C, and D of the portion where both end portions of the conductor lines 21 and 22 overlap through a dielectric layer 3. As shown in FIG. 8, the electric field concentrates in both ends, which are close to each other in the thickness direction and in the region shown by A to B and E to D, of the conductor lines 21 and 22. Here, plus and minus signs represent electric charges and arrows represent electric lines of force. Moreover, the electric field is also distributed between the end portion of each of the conductor lines 21 and 22 and the opposite conductor line close to the end portion, that is, in these areas shown by B' to B and D to D', and capacitance is also produced in these portions. However, since the length of the conductor lines contributing to generation of the capacitance is small, the extent of A to B and E to D in which both ends of the conductor lines overlap is supposed to be a capacitive area.

Regarding the distribution of the current density, in the same way as shown in FIG. 3B, the current strength rapidly increases from point A to point B of the conductor line, the current strength is substantially constant in the area between B and D, and the current strength rapidly decreases from D to E. The current strength becomes zero at both ends. The areas of A to B and D to E in which other ends of the conductor lines become close in the thickness direction are called capacitive areas and the other areas can be called inductive areas.

Figure 7C:
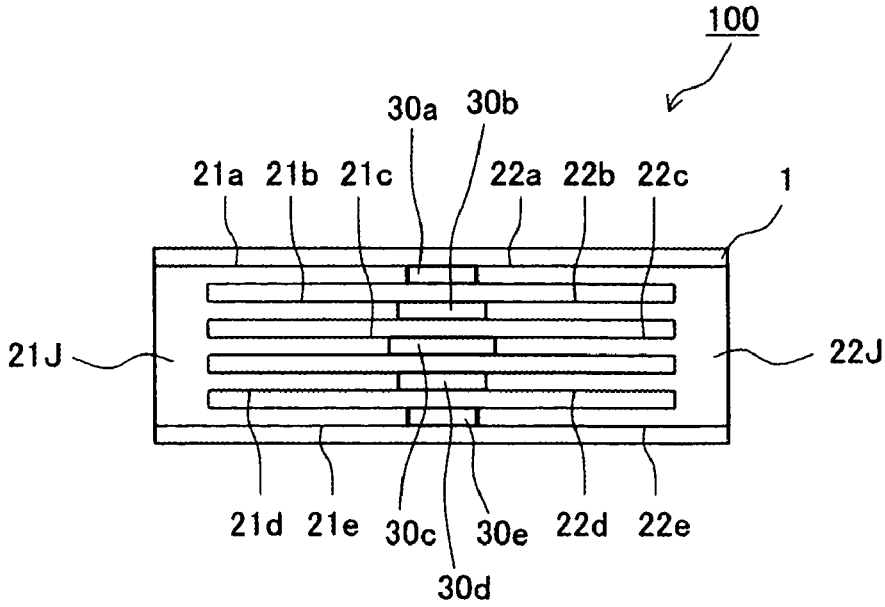

FIG. 7C is a top view of another high-frequency circuit element 100. In this example, a plurality of conductor lines of 21*a* to 21*e* and 22*a* to 22*e* are formed on the surface of the dielectric substrate 1, and capacitive areas 30*a* to 30*e* are formed such that the end portions of conductor lines are made close to each other in the thickness direction through a dielectric layer. The other end portions of the plurality of conductor lines are connected to the connection portions 21J and 22J. When the connection portions 21J and 22J are mounted on the above mounting substrate, a resonator device made of five resonance units is formed.

Figure 9A:
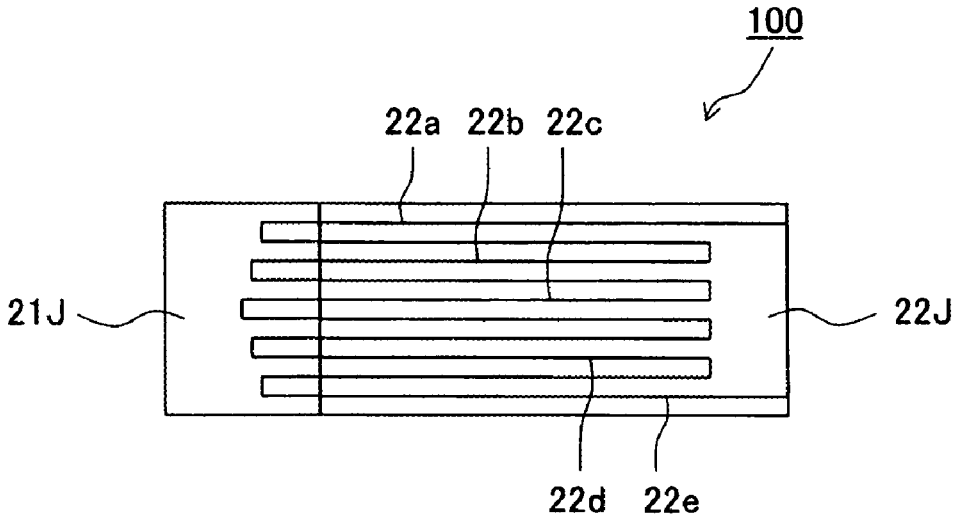
FIGS. 9A and 9B show a high-frequency circuit element in a resonator device according to a sixth embodiment of the present invention.
Figure 9B:
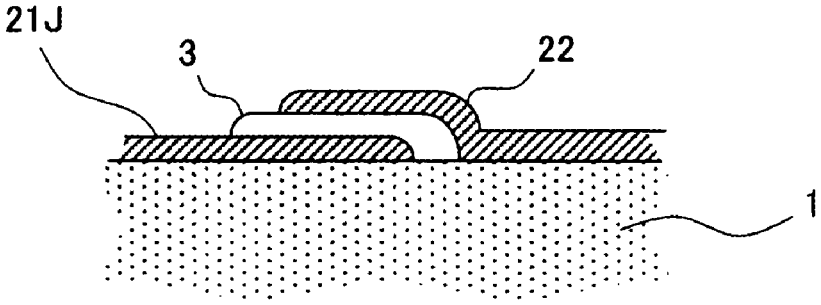

FIGS. 9A and 9B are a top view and a sectional view of a high-frequency circuit element 100 according to a sixth embodiment of the present invention. In the example shown in FIG. 7C, the capacitive areas 30*a* to 30*e* are disposed substantially in the middle of the dielectric substrate 1, but, in the example in FIG. 9, the end portions of the conductor lines 22*a* to 22*e* are made close in the thickness direction to the connection portion 21J through a dielectric layer.

Figure 10A:
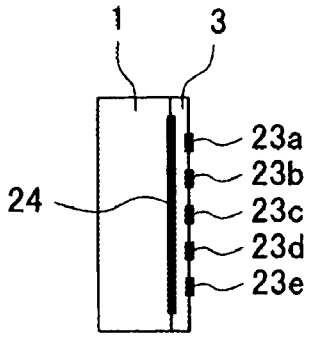
FIGS. 10A to 10D show a high-frequency circuit element in a resonator device according to a seventh embodiment of the present invention.
Figure 10B:
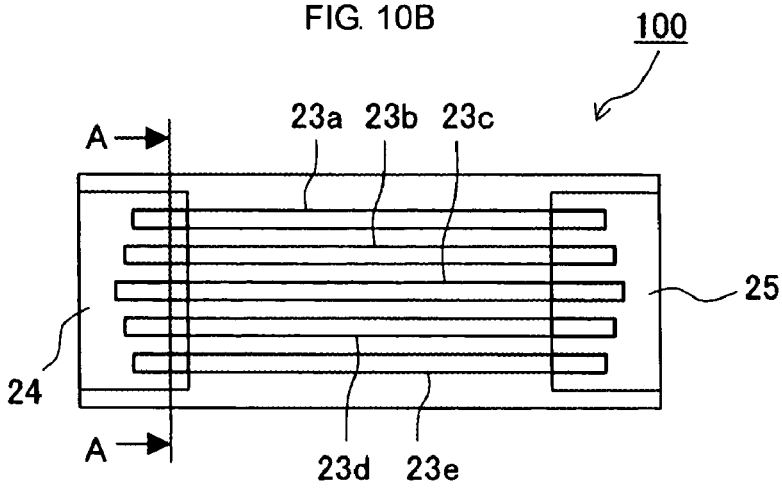
Figure 10C:
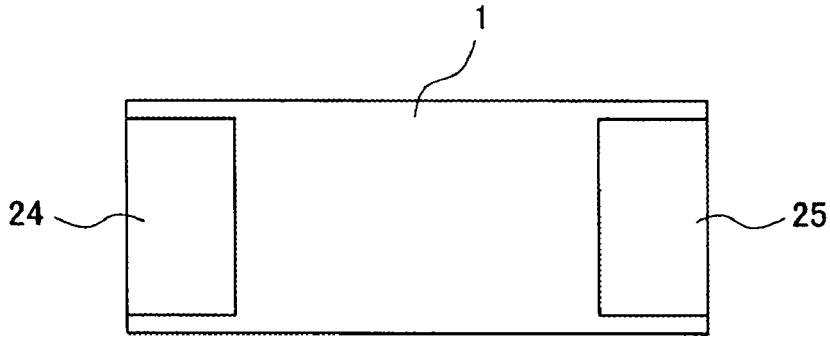
Figure 10D:
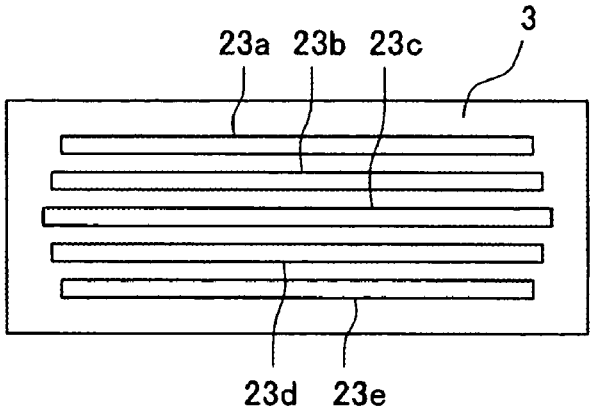

FIGS. 10A to 10C show a high-frequency circuit element 100 according to a seventh embodiment of the present invention. Here, FIG. 10B is a top view of the high-frequency circuit element 100, FIG. 10A is a sectional view taken on line A—A of Fig. B, FIG. 10C is a top view of the dielectric substrate, and FIG. 10D is a top view of the dielectric layer. Conductors 24 and 25 are formed on the upper surface of the dielectric substrate 1. A dielectric layer 3 is provided on the upper surface of the dielectric substrate and, in addition, conductor lines 23*a* to 23*e* are formed on the upper surface. Both end portions of these conductor lines 23*a* to 23*e* are made close in the thickness direction to the conductors 24 and 25 through the dielectric layer 3 to form capacitive areas.

Furthermore, conductor films made conductive to the conductors 24 and 25 are formed so as to extend from both end surfaces to the bottom surface of the dielectric substrate 1. When the high-frequency circuit element 100 is mounted on the mounting substrate, the conductor film on the bottom surface of the dielectric substrate 1 is connected to the shielding electrode. In this state, the portions excluding the capacitive areas of the conductor lines 23*a* to 23*w* and the shielding electrode of the mounting substrate function as inductive areas. Accordingly, this resonator device is provided with five resonance units, each having two capacitive areas and two inductive areas.

Figure 11A:
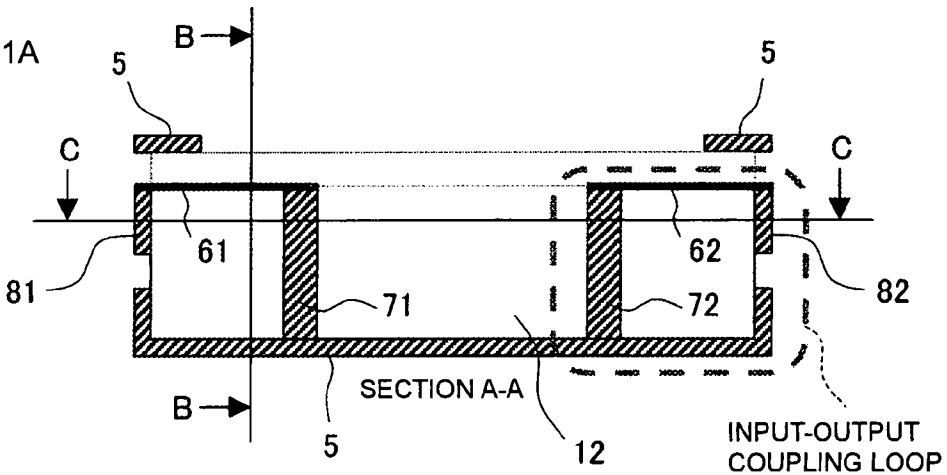
FIGS. 11A to 11D show a mounting substrate having input-output potions according to an eighth embodiment of the present invention.
Figure 11C:
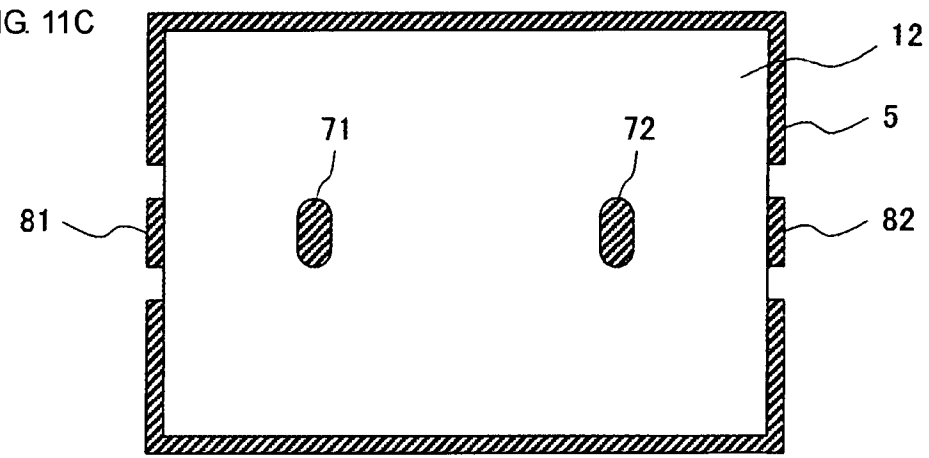
Figure 11D:
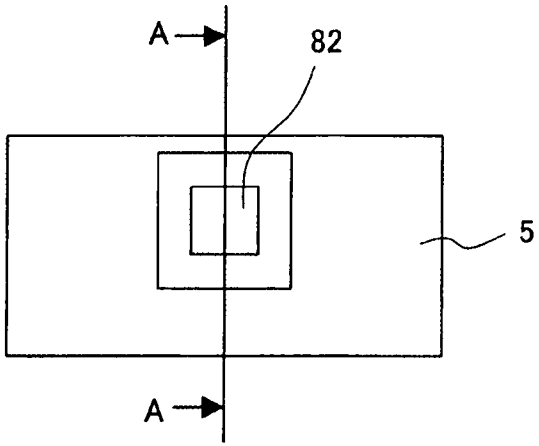
Figure 11B:
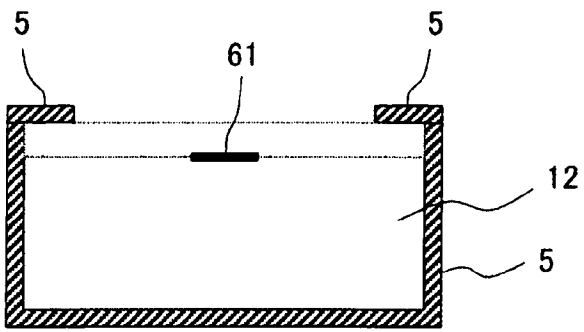

Next, a mounting substrate used in a filter according to an eighth embodiment of the present invention is described with reference to FIGS. 11A to 11D. FIG. 11A is a sectional view taken on line A—A of FIG. 11D, FIG. 11B is a sectional view taken on line B—B of FIG. 11A, and FIG. 11C is a sectional view taken on line C—C of FIG. 11A. The shielding electrode 5 is provided at the surrounding portion of the upper surface of a multilayer substrate 12 and on the other outer surfaces (five surfaces). Input-output terminals 81 and 82 are formed on the outer surfaces, opposite to each other, of the multilayer substrate 12. Furthermore, input-output coupling electrodes 61 and 62 are formed on a fixed layer of the multilayer substrate 12, and input-output coupling via holes 71 and 72 are formed so as to extend from the lowest layer to the fixed layer. The lower end portions of the input-output coupling via holes 71 and 72 are connected to the shielding electrode 5. Furthermore, one end of the input-output coupling electrode 61 and 62 is connected to the input-output terminals.

When constructed this way, the input-output coupling electrodes 61 and 62, the input-output coupling via holes 71 and 72, and the shielding electrode 5 form two coupling loops. The portion enclosed by a broken line in FIG. 1A shows one coupling loop.

When each high-frequency circuit element 100 shown in the first to seven embodiments is mounted on the mounting substrate having input-output portions constructed this way, the above-described coupling loops are magnetically coupled to the inductive areas of the high-frequency circuit element. Thus, the resonator device functions as a filter having a band-pass characteristic in which the input-output terminals 81 and 82 form input-output portions.

Figure 12A:
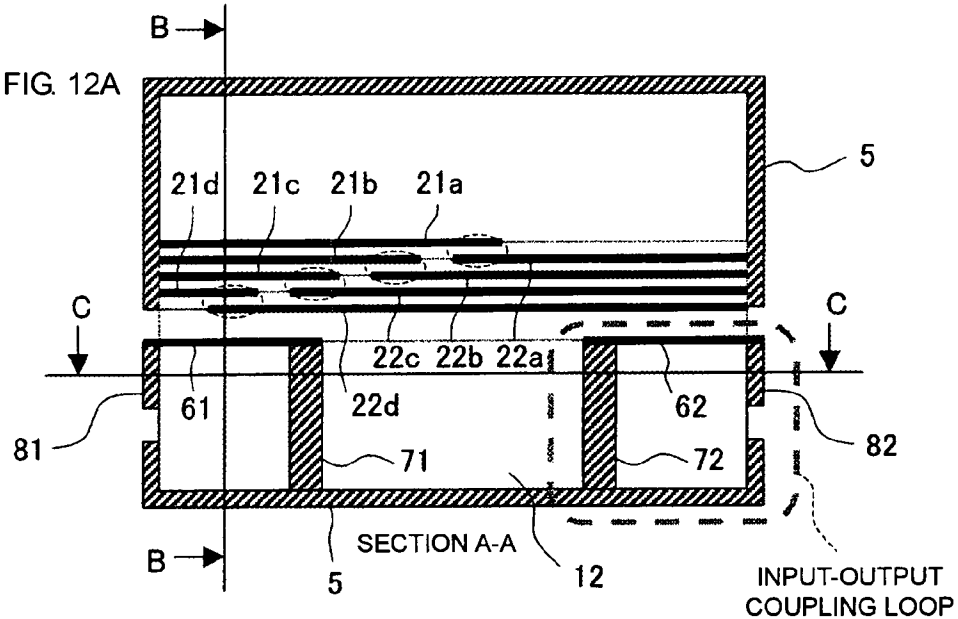
FIGS. 12A to 12D show a filter according to a ninth embodiment of the present invention.
Figure 12C:
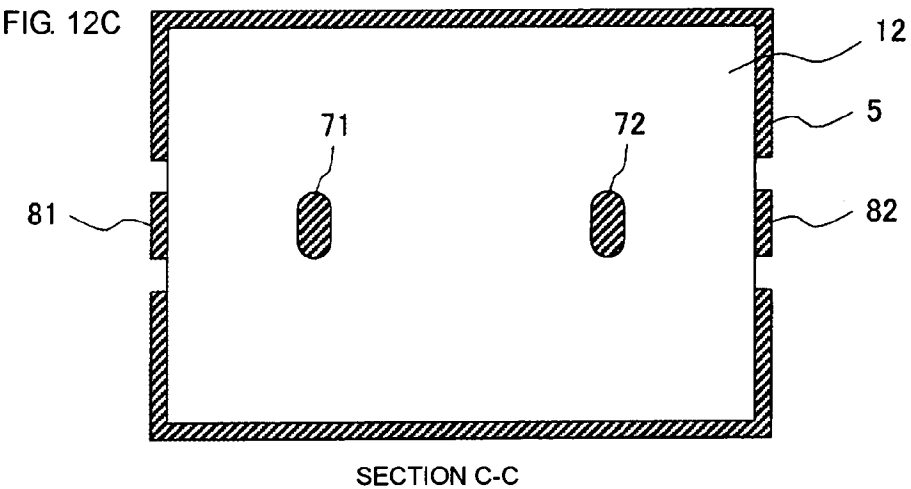
Figure 12D:
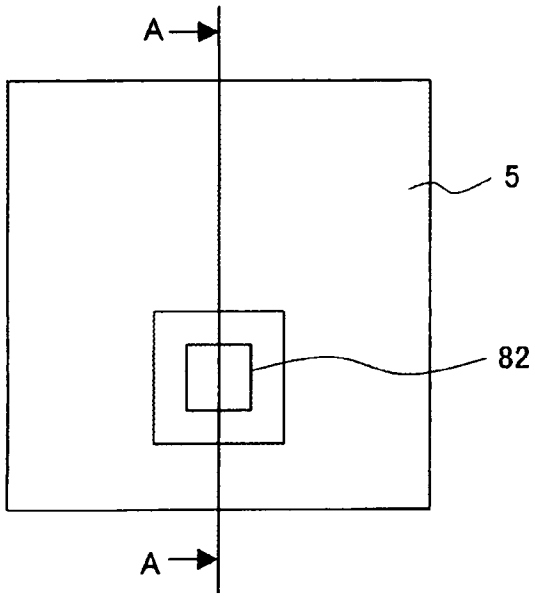
Figure 12B:
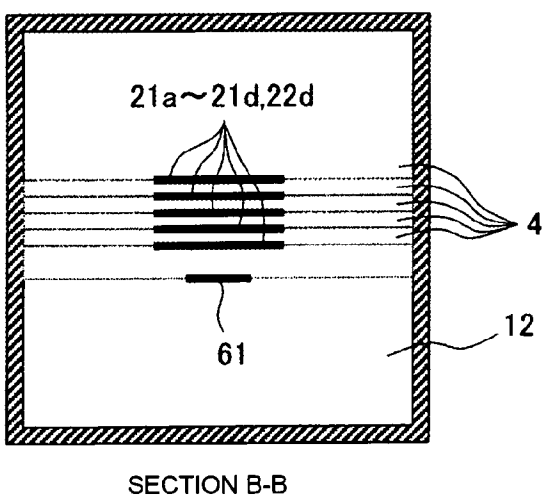

Next, a filter according to a ninth embodiment of the present invention is described with reference to FIGS. 12A to 12D and 13. FIG. 12A is a sectional view taken on line A—A of FIG. 12D, FIG. 12B is a sectional view taken on line B—B of FIG. 12A, and FIG. 12C is a sectional view taken on line C—C of FIG. 12A. The construction of the input-output coupling electrodes 61 and 62, input-output coupling via holes 71 and 72, and input-output terminals 81 and 82 of the multilayer substrate 12 in FIG. 12A is the same as that of the mounting substrate having input-output portions shown in FIG. 11A.

Conductor lines 21*a* to 21*d* and 22*a* to 22*d* are provided above the input-output coupling electrodes 61 and 62.

Figure 13:
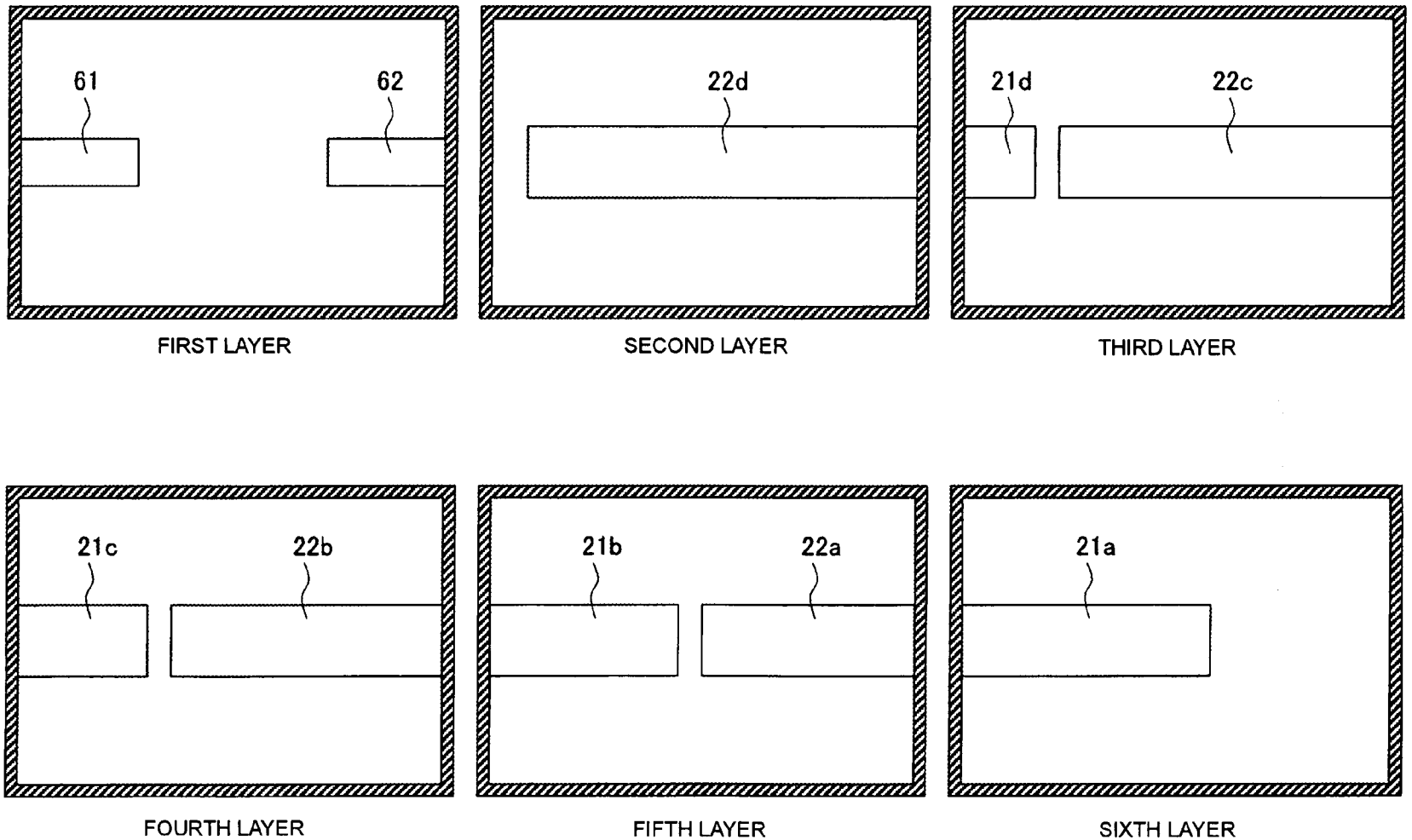
FIG. 13 is a top view of layers on which conductor lines of the filter are formed.

FIG. 13 is a top view of each layer where the above conductor lines are provided. The input-output coupling electrodes 61 and 62 are formed on a first layer. The conductor line 22*d* is formed on a second layer, the conductor lines 21*d* and 22*c* are formed on a third layer, the conductor lines 21*c* and 22*b* are formed on a fourth layer, the conductor lines 21*b* and 22*a* are formed on a fifth layer, and the conductor line 21*a* is formed on a sixth layer. These conductor lines form capacitive areas (areas shown by broken lines in the drawing) such that, as shown in FIG. 12A, the end portions of conductor lines comprising the same resonance unit are made close in the thickness direction through a dielectric layer. Four resonance units are disposed such that the plurality of capacitive areas do not overlap with each other in the thickness direction. Therefore, the electric-field vectors generated in neighboring capacitive areas become uniform in direction and the conductor loss in the conductor lines can be reduced.

A coupling loop formed by the input-output coupling electrode 61, input-output coupling via hole 71, and shielding electrode 5 shown in FIG. 12 and a coupling loop formed by the input-output coupling electrode 62, input-output coupling via hole 72, and shielding electrode 5 are magnetically coupled with a resonator comprising the above four resonance units. Thus, the filter shown in FIG. 12 functions as a filter having a band-pass characteristic which has input-output terminals 81 and 82 as input-output portions.

Figures 14A, 14B, 14C, 14D:
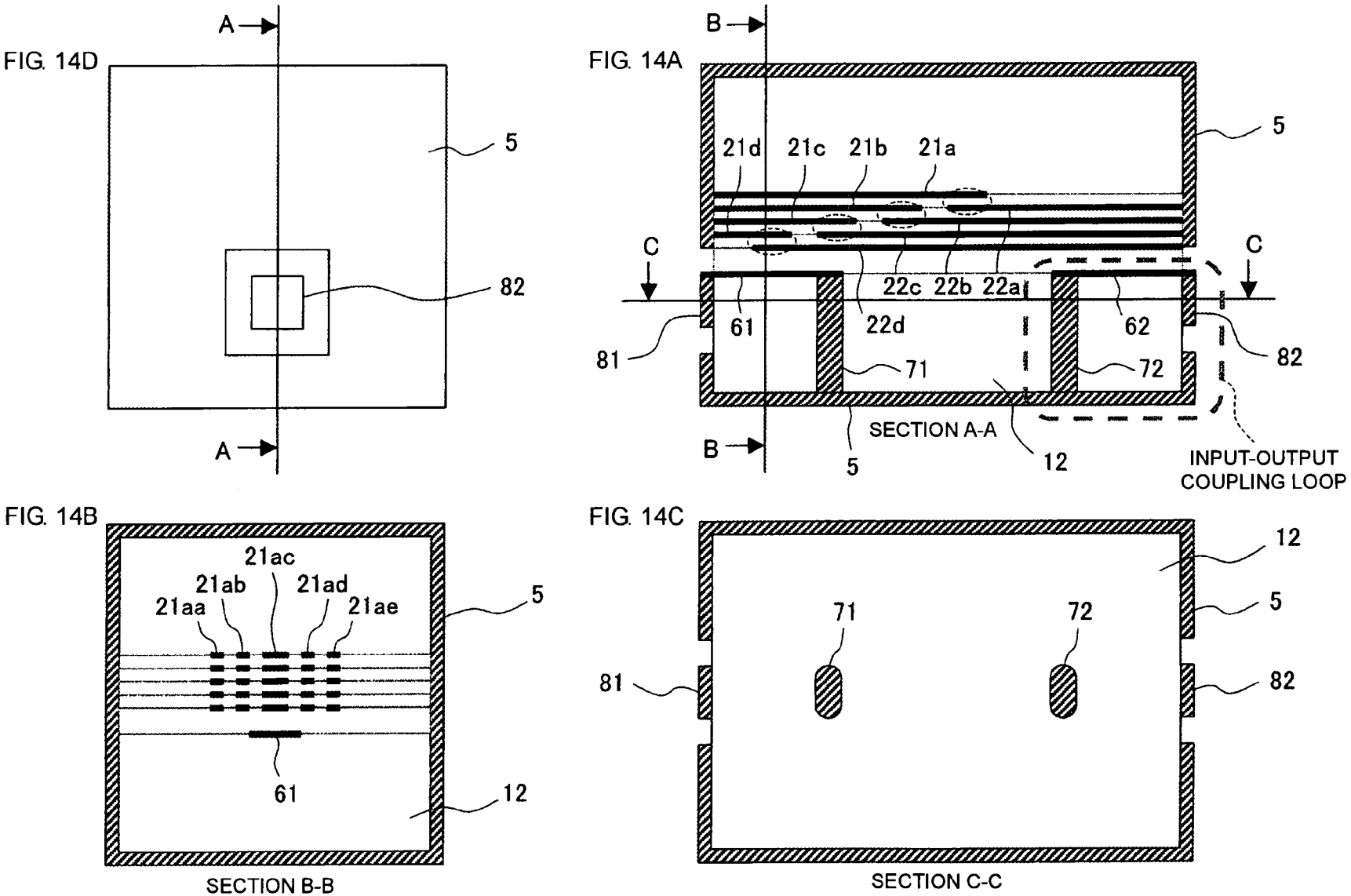
FIGS. 14A to 14D show a filter according to a tenth embodiment of the present invention.
Figure 15:
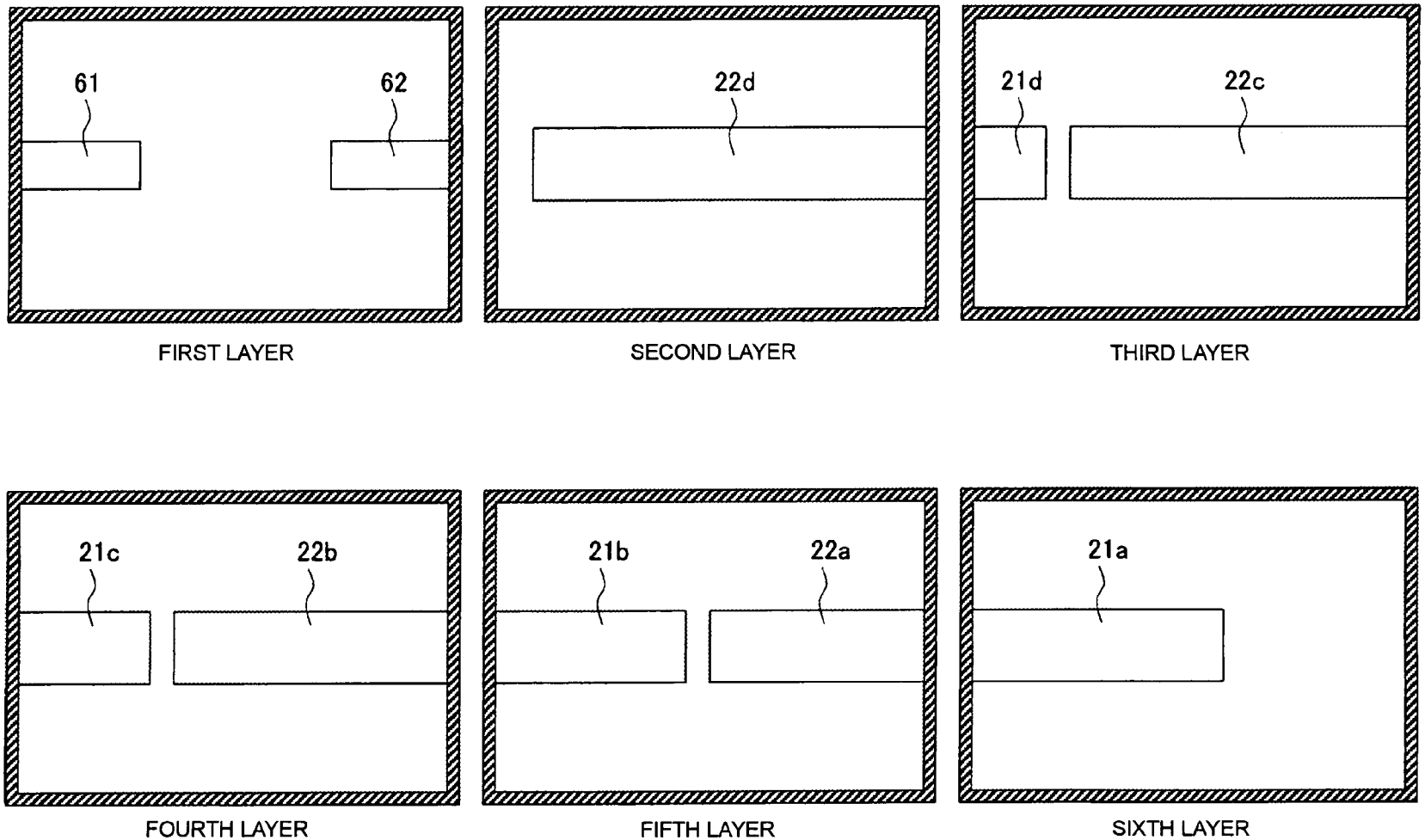
FIG. 15 is a top view of layers on which conductor lines of the filter are formed.

FIGS. 14A to 14D and 15 show a filter according to a tenth embodiment of the present invention. The shape of conductor lines formed on each layer of the multilayer substrate is different from that of the filter shown as the ninth embodiment in FIGS. 12A to 12D and 13. In the example shown in FIG. 13, the conductor line on each layer is made into a single line, but, in this tenth embodiment, conductor lines on each layer are made into an aggregate of a plurality of conductor lines. When a section perpendicular to the extending direction of conductor lines is viewed, the plurality of conductor lines are separated on each layer as shown in FIG. 14B FIG. 15 is a top view of each layer on which a conductor layer is formed. Input-output coupling electrodes 61 and 62 are formed on a first layer. Conductor lines 22*da* to 22*de* are formed on a second layer. Conductor lines 21*da* to 21*de* and 22*ca* to 22*ce* are formed on a third layer. Conductor lines 22*ca* to 22*ce* and 22*ba* to 22*be* are formed on a fourth layer. Conductor lines 21*ba* to 21*be* and lines 22*aa* to 22*ae* are formed on a fifth layer. Conductor lines 21*aa* to 21*ae* are formed on a sixth layer.

The width of conductor lines on each layer is gradually reduced from the middle to the outside in the width direction (perpendicular to the extending direction of conductor lines). However, in the example shown FIGS. 14A to 14D and 15, the middle conductor lines are made thicker. For example, the conductor line 21 ac on the sixth layer is made thicker than the conductor lines 21*aa*, 21*ab*, 21*ad*, and 21*ae* on both sides thereof. In this way, the edge effect of conductor lines is decreased and the conductor loss of conductor lines is reduced.

FIGS. 16A to 16D show a filter according to an eleventh embodiment of the present invention. FIG. 16A is a sectional view taken on line A—A of FIG. 16D, FIG. 16B is a sectional view taken on line B—B of FIG. 16A, and FIG. 16C is a sectional view taken on line C—C of FIG. 16A. In the example shown in FIGS. 14A to 14D, a resonator having four resonance units is provided, but, in the example shown in FIGS. 16A to 16D, three resonators shown by RLa, RLb, and RLc are formed. That is, as is understood in FIG. 16A, resonators having three capacitive areas are formed in the multilayer substrate. Furthermore, as is understood in FIG. 16B, the conductor lines on each layer are divided into three in the width direction, and the middle conductor line is made thicker and the width of conductor lines on both sides is thinner.

An input-output coupling loop is formed by the input-output coupling electrode 61, the input-output coupling via hole 71, and the shielding electrode 5 and is magnetically coupled with the resonator RLa. In the same way, another input-output coupling loop is formed by another set and is magnetically coupled with the resonator RLc. In FIG. 16C, the input-output coupling via hole 71 and another input-output coupling via hole 72 are shown. Furthermore, the input-output terminal 82 is made conductive to another input-output coupling electrode.

Since the neighboring resonators RLa and RLb and resonators RLb and RLc are coupled therebetween, a three-stage resonator is formed between the input-output terminals 81 and 82.

Figure 17C:
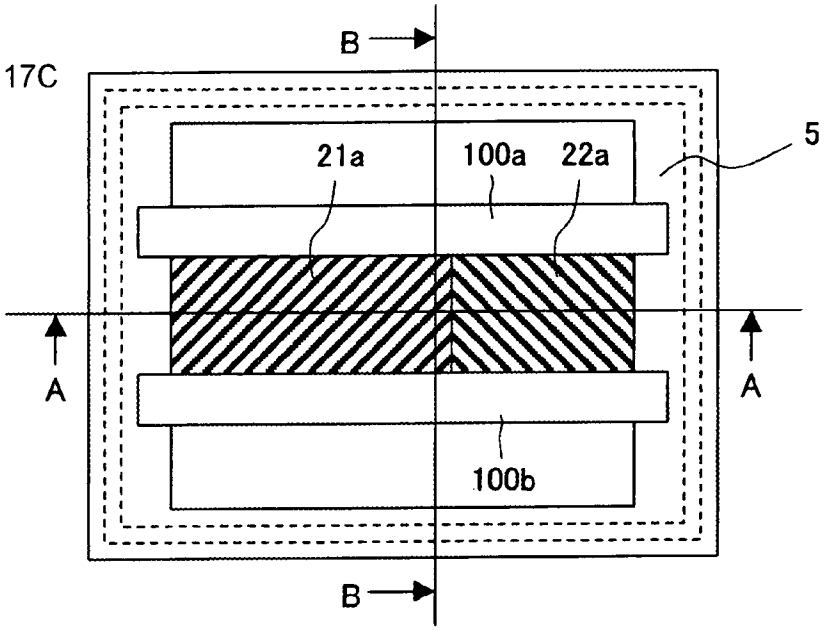
FIGS. 17A to 17C show a filter according to a twelfth embodiment of the present invention.
Figure 17A:
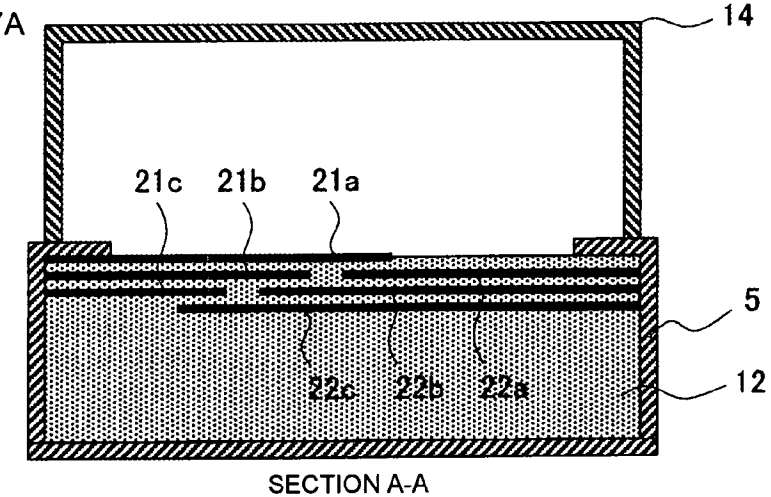
Figure 17B:
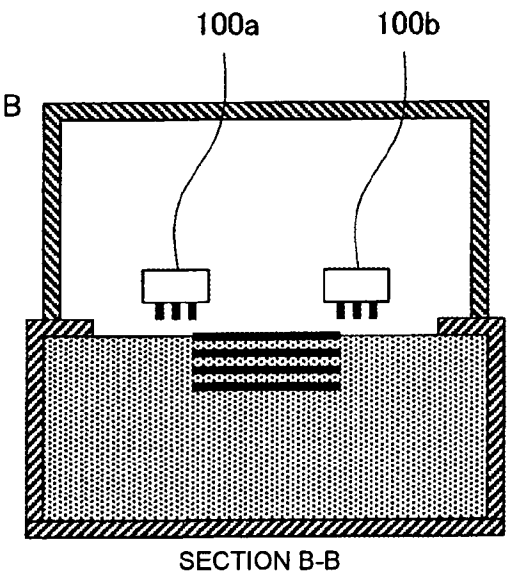

Next, a filter according to a twelfth embodiment of the present invention is described with reference to FIGS. 17A to 17C. FIG. 17C is a top view of the filter with the upper shielding cap 14 removed. FIG. 17A is a sectional view taken on line A—A of FIG. 17C, and FIG. 17B is a sectional view taken on line B—B of FIG. 17C.

In this example, conductor lines 21*a* to 21*c* and 22*a* to 22*c* are formed in the multilayer substrate 12, and capacitive areas are formed in the portions in which the end portions of conductor lines are made close in the thickness direction through a dielectric layer therebetween. The structure of the multilayer substrate is basically the same as that in FIGS. 12A to 12D except for the input-output coupling loops. In FIGS. 17*a* to 17C, high-frequency circuit elements 100*a* and 100*b* are mounted to the shielding electrode 5 on the upper surface of the multilayer substrate 12. The construction of these two high-frequency circuit elements 100*a* and 100*b* is basically the same as the high-frequency circuit element 100 shown in FIGS. 1A to 1C. However, in the example in FIGS. 17A to 17D, two resonance units are provided in each of the high-frequency circuit elements 100*a* and 100*b*.

In this way, one high-frequency circuit element is formed by the multilayer substrate 12 and a second high-frequency circuit element is formed by thin-film fine processing of another dielectric substrate to comprise one resonator device by combining both.

Next, a filter according to thirteenth embodiment of the present invention is described with reference to FIGS. 18*a* to 21.

In the examples shown in FIGS. 12A to 17C, although it is not concretely shown how the capacitance of the capacitive areas on each layer is determined, the capacitance of capacitive areas is made uneven in the thickness direction in the thirteenth embodiment.

Figure 18C:
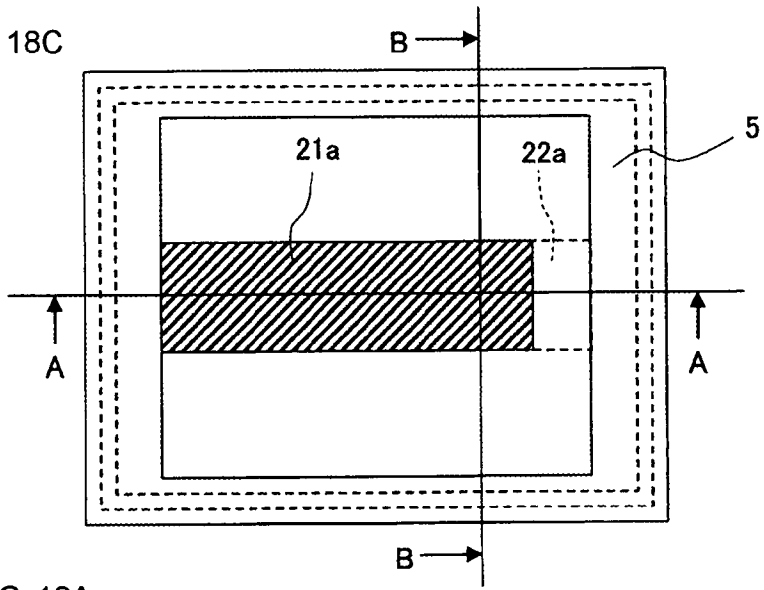
FIGS. 18A to 18C show a filter according to a thirteenth embodiment of the present invention.
Figure 18A:
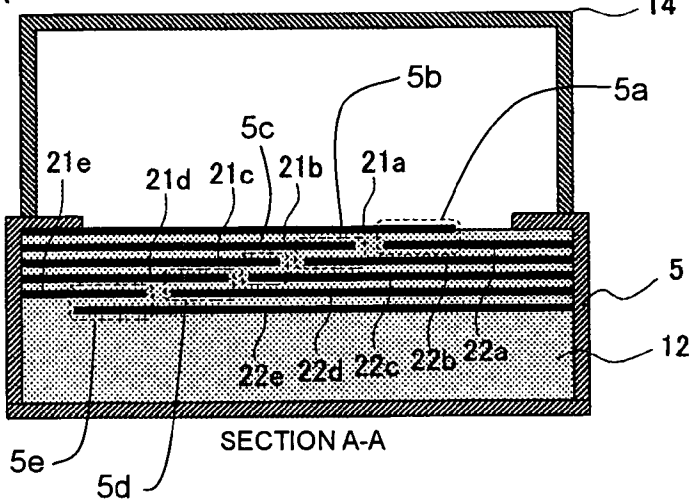
Figure 18B:
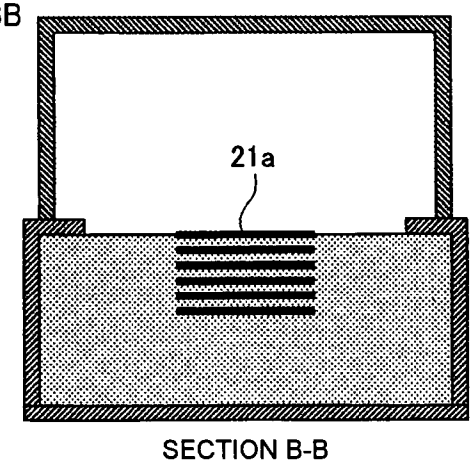

FIG. 18C is a top view of the filter with the upper shielding cap 14 removed. FIG. 18A is a sectional view taken on line A—A of FIG. 18C, and FIG. 18B is a sectional view taken on line B—B of FIG. 18C.

In this example, conductor lines 21*a* to 21*e* and 22*a* to 22*e* are formed in the multilayer substrate 12 and capacitive areas are formed in the portions in which the end portions of conductor lines are made close in the thickness direction through a dielectric layer. The structure of the multilayer substrate is basically the same as that in FIGS. 12A to 12D except for the input-output coupling loops. However, out of a plurality of sets of capacitive areas, the more outer the capacitive area of a resonance unit is disposed relative to the middle of the multilayer substrate 12, the larger the capacitance. That is, when the area of a portion in which the conductor lines 21*a* to 22*a* overlap in the thickness direction is represented by Sa, the area of a portion in which the conductor lines 21*b* to 22*b* overlap in the thickness direction is represented by Sb, the area of a portion in which the conductor lines 21*c* to 22*c* overlap in the thickness direction is represented by Sc, the area of a portion in which the conductor lines 21*d* to 22*d* overlap in the thickness direction is represented by Sd, and the area of a portion in which the conductor lines 21*e* to 22*e* overlap in the thickness direction is represented by Se, the following relation is established.

$Sa>Sb>Sc$, and $Se>Sd>Sc$

When the capacitance is distributed in this way, Q of the resonator can be increased as is described later.

Figure 19A:
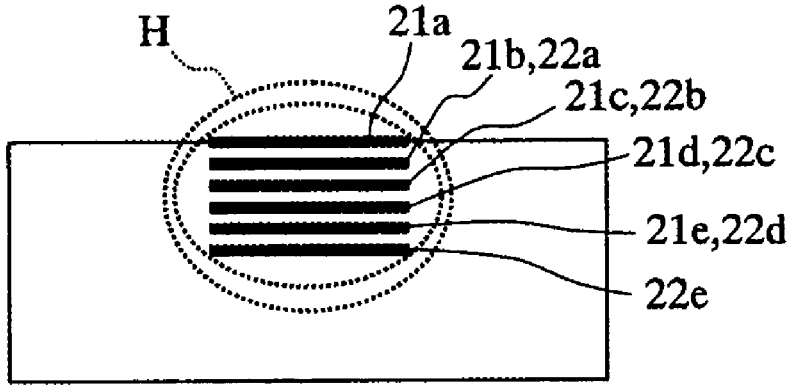
FIGS. 19*a* and 19B show examples of the distribution of magnetic field in a section in the thickness direction of a plurality of conductor lines of the filter.
Figure 19B:
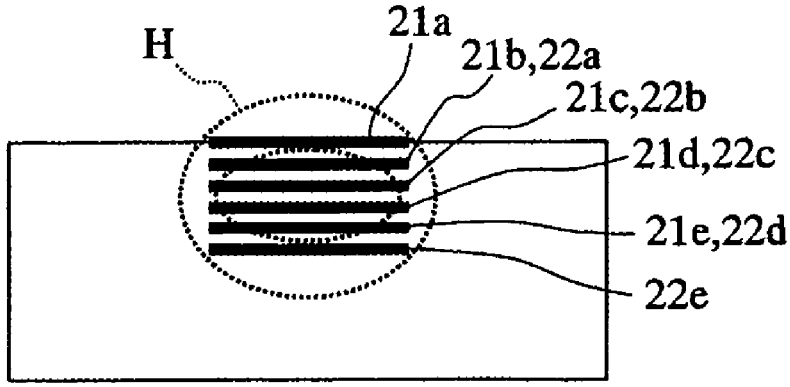

Next, the effect of improvement of Q due to the distribution of capacitance in the capacitive areas is described with reference to FIGS. 19A and 19B.

As shown in FIGS. 18A to 18C, in a resonator having the structure in which resonance units having conductor lines formed on each dielectric sheet are laminated, a magnetic field is generated by an electric current flowing in inductive areas of each resonance unit. In FIGS. 19A and 19B, examples of the distribution of a magnetic field H in a section of the multilayer substrate are shown. FIG. 19A generally shows the distribution of a magnetic field in the case in which, as shown in FIGS. 18A to 18C, the current is unevenly distributed in the thickness direction such that the current in the outermost layers in the thickness direction (uppermost layer and lowest layer) becomes larger than the current in the other layers (inner layers), and FIG. 18B shows the distribution of a magnetic field in the case in which the current flowing in conductor lines on each layer is equal.

In this way, regarding a plurality of resonance units, the current is distributed so as to be uneven in the thickness direction such that the more outer the capacitive area of a resonance unit is disposed, the greater the capacitance of the capacitive area of the resonance unit, and the current flowing on an outer layer is larger than the current flowing on an inner layer. Then, when a section of the portion where the plurality of resonance units are laminated is viewed, the magnetic field in a local circle out of a magnetic field generated by the current flowing through the inductive areas on other layers is decreased and the magnetic field tends to be distributed so as to encircle the whole laminated conductor lines.

Since the above magnetic field in a local circle enters the capacitive areas on inner layers, the conductor loss is caused in the capacitive areas.

Here, the relation among no-load Q (Q0), conductor Q (Qc), and dielectric Q (Qd) is expressed by the following equation (1).

Formula 1

$$\frac{1}{Q_0} = \frac{1}{Q_c} + \frac{1}{Q_d} \tag{1}$$

Furthermore, Qc out of these can be expressed by the following equation (2).

Formula 2

$$\frac{1}{Q_c} = \frac{W_{m1}}{W_{m1} + W_{m2}} \cdot \frac{1}{Q_{c1}} + \frac{W_{m2}}{W_{m1} + W_{m2}} \cdot \frac{1}{Q_{c2}} \tag{2}$$

In equation (2), Qc1 represents conductor Q which depends on conductor lines on the outermost layers (uppermost layer and lowest layer) out of the laminated conductor lines and Qc2 represents conductor Q which depends on conductor lines on the other inner layers. Wm1 represents a magnetic-field energy stored on the outermost layers and Wm2 represents a magnetic-field energy stored on the other layers. Here, since Qc2 is about two digits smaller than Qc1, when compared with Qc1, Qc can be improved by decreasing the influence of Qc2. It is enough to reduce Wm2 for that purpose. In order to decrease the magnetic-field energy Wm2 stored on the inner layers, the current flowing through the conductor lines 21 and 25 on the outermost layers is made relatively larger than the current flowing through the conductor lines on the inner layers. In order to realize that, the capacitance of capacitive areas on the outermost layers may be made relatively larger than the capacitive areas on the inner layers.

Figure 21:
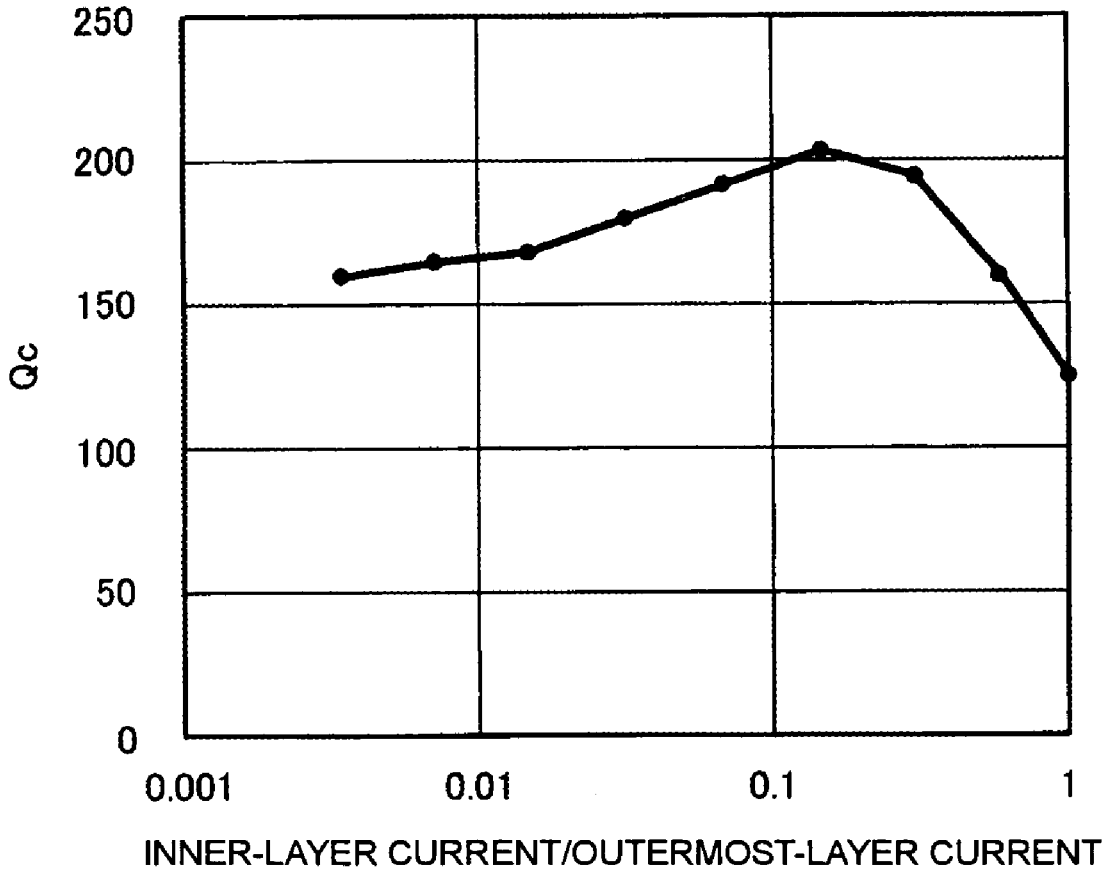
FIG. 21 shows the relation between the ratio of current flowing on the inner layers to current flowing on the outermost layers and Qc.

FIG. 21 shows the effect of the improvement of Qc obtained by performing a simulation such that nine sets of capacitive areas having the structure shown in FIGS. 18A to 18C are provided, that the ratio of the current flowing through conductor lines on inner layers to the current flowing through conductor lines on the outermost layers is represented by the horizontal axis, and that Qc obtained is represented by the vertical axis.

In this way, when the ratio of the current flowing through conductor lines on the inner layers to the current flowing through conductor lines on the outermost layers changes, Qc has a peak value, that is, it is understood that there is an optimum value. Therefore, the current ratio to obtain the highest Qc is sought first, and then, the ratio of the capacitance of the capacitive areas on the inner layers to the capacitance of the capacitive areas on the outermost layers may be determined so as to obtain the current ratio.

In the example shown in FIGS. 18A to 18C, regarding the plurality of capacitive areas, although the area of the portions which overlap in the thickness direction is made different in order that the more outside the capacitive area of a resonance unit is disposed, the larger the capacitance of the capacitive area may be, the capacitance of the capacitive areas on the inner layers excluding the outermost layers is made substantially equal and the capacitance of the capacitive areas on the outermost layers is made larger than that of the capacitive areas on the inner layers. Even in that case, Q can be improved because of the same effect.

Figure 20A:
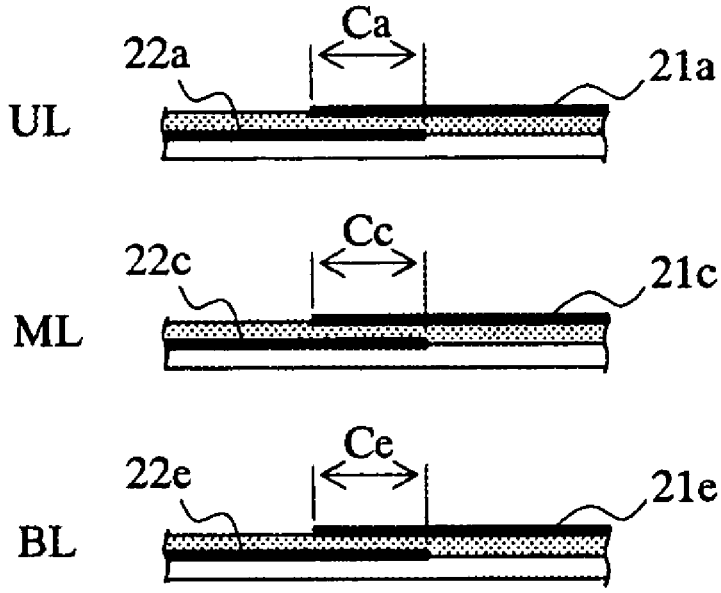
FIGS. 20A and 20B show capacitive areas of a plurality of resonance units which are laminated.
Figure 20B:
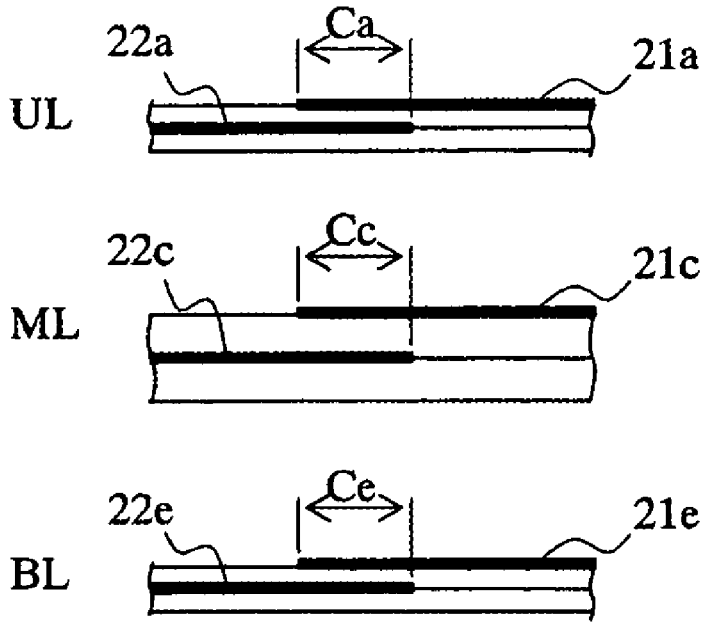

In the example shown in FIGS. 18A to 18C, although the capacitances are made different such that the area of the overlapping portions of conductor lines in the thickness direction is made different, the capacitance of capacitive areas can be determined by using other structures. In FIGS. 20A and 20B, two examples having different constructions are shown in order that the capacitances may be made different.

Here, a section of the capacitive areas on the uppermost layer UL, the inner layer ML, and the lowest layer BL is shown.

In the example shown in FIG. 20A, the dielectric constant of a dielectric sheet sandwiched between conductor lines forming the capacitive areas Ca and Ce on the uppermost layer UL and the lowest layer BL is made larger than the dielectric constant of a dielectric sheet sandwiched between conductor lines forming a capacitive area Cc on the inner layer ML. Because of this, the capacitance produced in the capacitive area Ca on the uppermost layer UL and the capacitive area Ce on the lowest layer BL becomes larger than the capacitance produced in the capacitive area Cc on the inner layer ML.

In the example shown in FIG. 20B, the distance between the facing conductor lines forming the capacitive areas Ca and Ce of the uppermost layer UL and the lowest layer BL is made smaller than the distance between the facing conductor lines forming the capacitive area Cc of the inner layer ML. Thus, the capacitance produced in the capacitive area Ca of the uppermost layer UL and the capacitive area Ce of the lowest layer BL is made larger than the capacitance produced in the capacitive area Cc of the inner layer ML.

In this way, the current flowing through the conductor line 21*a* of the uppermost layer UL and the conductor line 22*e* of the lowest layer BL is made relatively larger than the current flowing through the conductor line of the inner layer and thus, the magnetic-field energy entering the capacitive area of the inner layer is reduced and, as a result, no-load Q of the resonator can be improved.

Moreover, in the above example, in order to determine the capacitance of capacitive areas of each layer, the outermost capacitive areas of the outermost layers are handled in a different way from the capacitive areas of the other layers.

However, the thickness and dielectric constant of each dielectric sheet are determined and the facing area of conductor lines may be determined so that the closer to the outer layers rather than to the middle layer, the larger the capacitance of the capacitive area.

In the conductor lines shown in the above embodiments, electrode materials of normal conductors such as Cu, Ag, Au, etc. can be used. Furthermore, these conductor lines may comprise superconductor materials. When the superconductor materials perform the operation of superconductivity, it is preferred that the maximum magnetic-field strength be a critical magnetic-field strength or less and that the maximum current density be a critical current density or less. That is, when a large signal exceeding the critical magnetic-field strength and the critical current density is applied, no superconductivity operation is performed and high-frequency characteristics drastically change beyond the critical magnetic-field strength and the critical current density.

According to the present invention, when the conductor lines are formed by a plurality of conductor lines parallel to each other, since the magnetic-field strength and the current density can be effectively reduced, the endurable electric power is improved and a resonator used for a large electric power can be easily constructed.

Figure 22A:
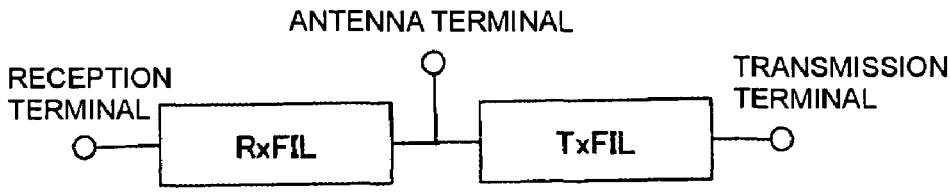
FIG. 22A shows a duplexer according to a fourteenth embodiment of the present invention and FIG. 22B is a block diagram showing a communication device using the duplexer.

Next, a duplexer according to a fourteenth embodiment of the present invention is described with reference to FIG. 22A. FIG. 22A is a block diagram of a duplexer. Here, each of a transmission filter TxFIL and a reception filter RxFIL is formed similar to the embodiments shown in FIG. 12A to FIG. 18C. The pass band of the transmission filter TxFIL and the reception filter RxFIL is designed in accordance with each band. Furthermore, when connected to an antenna terminal as a transmission and reception common terminal, a phase adjustment is performed so as to prevent a transmission signal from leaking to the reception filter and to prevent a reception signal from leaking to the transmission filter.

Figure 22B:
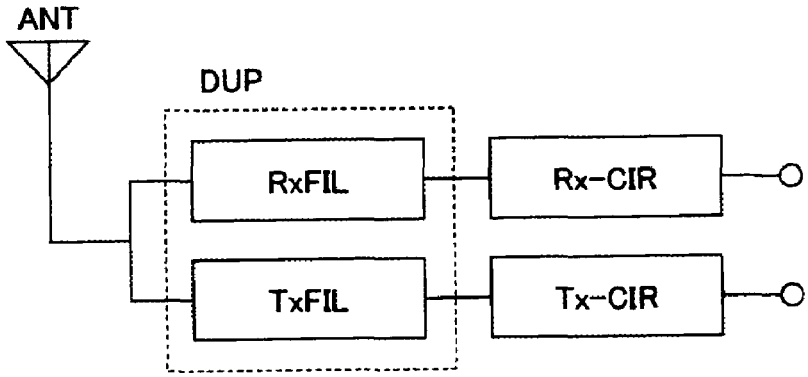

FIG. 22B is a block diagram showing a communication device. Here, the duplexer shown in FIG. 22A is used as the duplexer DUP. A transmission circuit Tx-CIR and a reception circuit Rx-CIR are formed on a circuit board, and the duplexer DUP is mounted on the circuit board such that the transmission circuit Tx-CIR is connected to a transmission signal input terminal of the duplexer DUP, the reception circuit Rx-CIR is connected to a reception signal output terminal, and an antenna ANT is connected to the antenna terminal.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A resonator device comprising:

a mounting substrate having a conductor formed thereon;

a dielectric substrate mounted on the mounting substrate; and a plurality of resonance units formed on the dielectric substrate, each resonance unit having a plurality of conductor lines forming a capacitive area and an inductive area in a ring shape, wherein the capacitive area is formed such that end portions of the plurality of conductor lines of each resonance unit of the plurality of resonance units are made close to each other in a width direction on the dielectric substrate, the capacitive areas of each of the resonance units are disposed such that a direction of electric-field vectors generated in the capacitive areas is uniform, and the inductive area is formed by a portion of the conductor lines, except for the capacitive area of the conductor lines formed on the dielectric substrate, and the conductor formed on the mounting substrate.

2. The resonator device as claimed in claim 1, wherein the plurality of conductor lines formed on the dielectric substrate are parallel to each other and a width of at least a part of each conductor line of the plurality of conductor lines is less than a skin depth at a frequency of a signal being propagated on the plurality of conductor lines.

3. A resonator device comprising:

a high-frequency circuit element mounted on the mounting substrate, the high-frequency circuit element including the resonator device as claimed in claim 1, wherein the mounting substrate comprises:

a multilayer substrate having the conductor formed on at least a part of an outer surface thereof, and a plurality of mounting-side resonance units formed in the multilayer substrate, each mounting-side resonance unit having a plurality of conductor lines forming a mounting-side capacitive area and a mounting-side inductive area in a ring shape, wherein the mounting-side capacitive area is formed such that end portions of the plurality of conductor lines of each mounting-side resonance unit are made close to each other in a thickness direction of the multilayer substrate through a dielectric layer, and the mounting-side capacitive areas are disposed in the multilayer substrate such that neighboring mounting-side capacitive areas do not overlap each other in the thickness direction, and wherein the mounting-side inductive area is formed by a portion of the plurality of conductor lines, except for the mounting-side capacitive area of the plurality of conductor lines formed in the multilayer substrate, and the conductor formed on the at least a part of the outer surface of the multilayer substrate.

4. A communication device comprising:

the filter as claimed in claim 3.

5. The resonator device as claimed in claim 1, wherein the plurality of conductor lines formed on the dielectric substrate are parallel to each other and a width of at least a part of each conductor line of the plurality of conductor lines is gradually made smaller from a middle out in a direction perpendicular to an extending direction of the plurality of conductor lines.

6. A resonator device comprising:

a mounting substrate having a conductor formed thereon;

a dielectric substrate mounted on the mounting substrate; and a resonance unit having a plurality of conductor lines forming a capacitive area and an inductive area in a ring shape, wherein the capacitive area is formed such that end portions of the conductor lines of the resonance unit are made close to each other in a thickness direction through at least a dielectric layer on the dielectric substrate, wherein the inductive area is formed by a portion of the conductor lines, except for the capacitive area of the conductor lines formed on the dielectric substrate, and the conductor formed on the mounting substrate.

7. The resonator device as claimed in claim 6, wherein the plurality of conductor lines formed on the dielectric substrate are parallel to each other and a width of at least a part of each conductor line of the plurality of conductor lines is less than a skin depth at a frequency of a signal being propagated on the plurality of conductor lines.

8. A resonator device comprising:

a high-frequency circuit element mounted on the mounting substrate, the high frequency circuit element including the resonator device as claimed in claim 2, wherein the mounting substrate comprises:

a multilayer substrate having the conductor formed on at least a part of an outer surface thereof, and a plurality of mounting-side resonance units formed in the multilayer substrate, each mounting-side resonance unit having a plurality of conductor lines forming a mounting-side capacitive area and a mounting-side inductive area in a ring shape, wherein the mounting-side capacitive area is formed such that end portions of the plurality of conductor lines of each mounting-side resonance unit are made close to each other in a thickness direction of the multilayer substrate through a dielectric layer, and the mounting-side capacitive areas are disposed in the multilayer substrate such that neighboring mounting-side capacitive areas do not overlap each other in the thickness direction, and wherein the mounting-side inductive area is formed by a portion of the plurality of conductor lines, except for the mounting-side capacitive area of the plurality of conductor lines formed in the multilayer substrate, and the conductor formed on the at least a part of the outer surface of the multilayer substrate.

9. The resonator device as claimed in claim 6, wherein the plurality of conductor lines formed on the dielectric substrate are parallel to each other and a width of at least a part of each conductor line of the plurality of conductor lines is gradually made smaller from a middle out in a direction perpendicular to an extending direction of the plurality of conductor lines.

10. A resonator device comprising:

a multilayer substrate;

a conductor formed on at least a part of an outer surface of the multilayer substrate; and a plurality of resonance units formed in the multilayer substrate, each resonance unit having a plurality of conductor lines forming a capacitive area and an inductive area in a ring shape, wherein the capacitive area is formed such that end portions of conductor lines of each resonance unit are made close to each other in a thickness direction of the multilayer substrate through a dielectric layer, and the capacitive areas are disposed in the multilayer substrate such that neighboring capacitive areas do not overlap each other in the thickness direction, and wherein the inductive area is formed by a portion of the conductor lines, except for the capacitive area of the conductor lines formed in the multilayer substrate, and the conductor formed on the at least a part of the outer surface of the multilayer substrate.

11. The resonator device as claimed in claim 10, wherein a thickness of at least a part of the conductor lines formed in the multilayer substrate is made less than a skin depth at a frequency of a signal being propagated on the conductor lines.

12. The resonator device as claimed in claim 11, wherein a capacitance of the capacitive area of an outermost resonance unit in the thickness direction of the multilayer substrate is larger than a capacitance of the capacitive areas of the other resonance units of the plurality of resonance units.

13. The resonator device as claimed in claim 11, wherein the plurality of resonance units are formed such that a capacitance of the capacitive area of the resonance units increases from a middle portion of the multilayer substrate along the thickness direction of the multilayer substrate.

14. The resonator device as claimed in claim 10, wherein a capacitance of the capacitive area of an outermost resonance unit in the thickness direction of the multilayer substrate is larger than a capacitance of the capacitive areas of the other resonance units of the plurality of resonance units.

15. The resonator device as claimed in claim 10, wherein the plurality of resonance units are formed such that a capacitance of the capacitive area of the resonance units increases from a middle portion of the multilayer substrate along the thickness direction of the multilayer substrate.

16. The resonator device as claimed in claim 10, wherein the conductor lines formed in the multilayer substrate are a plurality of conductor lines parallel to each other and a width of at least a part of each conductor line is gradually made smaller from a middle out in a direction perpendicular to an extending direction of the conductor lines.

17. The resonator device as claimed in any one of claims 1 to 8, wherein at least a part of the conductor or the plurality of conductor lines comprises a superconductor material.

18. A filter comprising:

the resonator device as claimed in claim 17; and input-output terminals that couple input-output signals to the resonance unit of the resonator device.

19. A duplexer comprising:

a transmission filter; and a reception filter, wherein the filter as claimed in claim 18 is used in the transmission filter, in the reception filter, or in both of the transmission filter and the reception filter.

20. A communication device comprising:

the duplexer as claimed in claim 19.

* * * * *